US005471290A

United States Patent [19]

Nagayama et al.

[11] Patent Number: 5,471,290

[45] Date of Patent: Nov. 28, 1995

[54] IMAGE FORMING APPARATUS

[75] Inventors: Masato Nagayama; Seiji Inuyama; Kenji Sawada; Makoto Ohshita; Fumiaki Harada, all of Kawasaki, Japan

[73] Assignee: Fujitsu Limited, Kanagawa, Japan

[21] Appl. No.: 228,217

[22] Filed: Apr. 15, 1994

[30] Foreign Application Priority Data

May 20, 1993 [JP] Japan ..... 5-142903

[51] Int. Cl.[6] ..... G03G 21/00

[52] U.S. Cl. ..... 355/309; 271/228; 271/259; 271/280; 271/298; 355/204; 355/207; 355/208; 355/316; 355/317; 355/321

[58] Field of Search ..... 355/203, 204, 355/205, 207, 208, 308, 309, 317, 316, 321; 271/228, 258, 259, 270, 265, 280, 279, 298, 303

[56] References Cited

U.S. PATENT DOCUMENTS

| | | | |
|---|---|---|---|
| 4,971,304 | 11/1990 | Lofthus | 271/265 X |
| 5,018,718 | 5/1991 | Matsuno et al. | 355/317 X |
| 5,043,771 | 8/1991 | Shibata et al. | 355/317 |
| 5,094,442 | 3/1992 | Kamprath et al. | 271/265 X |
| 5,112,038 | 5/1992 | Dunaway | 271/265 X |
| 5,169,140 | 12/1992 | Wenthe, Jr. | 271/228 |
| 5,197,726 | 3/1993 | Nogami | 271/270 X |

FOREIGN PATENT DOCUMENTS

| | | | |
|---|---|---|---|
| 0014159 | 1/1983 | Japan | 355/317 |
| 0077051 | 5/1985 | Japan . | |
| 0051428 | 3/1986 | Japan . | |
| 61-235337 | 10/1986 | Japan . | |
| 0136442 | 6/1987 | Japan . | |
| 0208065 | 9/1987 | Japan | 355/317 |
| 63-230451 | 9/1988 | Japan . | |
| 1-214555 | 8/1989 | Japan . | |
| 3-88670 | 4/1991 | Japan . | |

*Primary Examiner*—Matthew S. Smith

[57] ABSTRACT

An image forming apparatus for continuously feeding sheets and transferring images thereon, includes an endless type rotatable image forming body, an image forming unit for forming an image on the image forming body, a transfer unit for transferring the image on the image forming body onto a sheet being fed, a feeding unit for feeding the sheet, a first position detector for detecting the sheet being fed at a first predetermined position in a feeding path of the sheet, and a second position detector, located on a side of the transfer unit at a second predetermined position, for detecting the sheet being fed. A control unit is provided for controlling a feeding speed of the feeding unit to compensate for a transfer position of the sheet, in accordance with a measured feeding time from the first predetermined position to the second predetermined position based on outputs of the first and second position detectors.

20 Claims, 19 Drawing Sheets

IMAGE FORMING APPARATUS

BACKGROUND OF THE INVENTION

1. Field of the Invention

The present invention relates to an image forming apparatus which continuously feeds sheets from a hopper and forms an image on each sheet.

2. Description of the Related Art

Image forming apparatuses, such as a copying machine, a printer and a facsimile, use a latent-image forming type recording apparatus like an electrophotographing apparatus due to a strong demand for printing on normal sheets of paper. Such an image forming apparatus first forms an electrostatic latent image on a photosensitive drum and then develops this electrostatic latent image, yielding a toner image. The image forming apparatus then transfers the toner image on the photosensitive drum onto a sheet of paper. In this transfer process, the sheet should be fed in synchronism with the timing of transferring the toner image on the sheet. If this timing is mismatched, the toner image undesirably shifts forward or backward on the sheet in the sheet feeding direction. Accordingly, a part of the intended print contents (toner image) may not be formed on the sheet.

In the transfer process, the sheet feeding speed should match with the rotational speed of the photosensitive drum (the moving speed of the toner image). To align the sheet with the toner image, the leading edge of the sheet should be parallel to the photosensitive drum 10 and the sheet should be fed in alignment with the toner image.

A sheet to be printed is first picked up from a hopper, is subjected to image transfer from the photosensitive drum, and is then received on a stacker through a fixing process. The position of the sheet during the feeding is likely to deviate from a desired position due to the slipping of the sheet at the time the sheet has been picked up from the hopper or sheet slipping during the feed. It is therefore difficult to align the sheet with the toner image on the photosensitive drum at the time of picking up the sheet. For instance, due to the material for sheets, a variation in the quality of sheets caused during the production and the ambient conditions such as humidity, the sheets may not have a uniform thickness or the amount of electrostatic charges on a sheet may not be uniform over the surface of the sheet, so that the feeding of sheets may vary from one sheet to another sheet.

To conduct a fast printing particularly, adequate measures should be taken since the distance from the hopper to the photosensitive drum is long and the positional deviation is accumulated as a sheet travels along the feeding path.

FIGS. 1, 2 and 3 are exemplary diagrams of prior art.

In an electrophotographing apparatus, for example, resist rollers R3 for adjusting the feeding timing are provided in the feeding path near a photosensitive drum 10 on which a toner image is to be formed, as shown in FIG. 1. Two sets (right and left sets) of feed rollers each set consisting of an upper roller and a lower roller are often used as the resist rollers R3. The resist rollers R3 rotate in the forward direction as well as in the reverse direction.

The conventional image forming operation will now be described with reference to FIGS. 2 and 3. Pickup rollers PR are activated to pick up sheets from a hopper 20. At the same time, feed rollers R1 and R2 are rotated. As a result, a sheet is picked up and fed by the feed rollers R1. When a sensor PS1 detects that the sheet has been picked up in this pickup operation, the rotation of the pickup rollers PR is stopped. An image drawing operation which an information light is impinged to the photosensitive drum 10, is started in synchronous with a detection on a front edge of a sheet by a detection sensor PS1.

When the leading edge of the sheet which is fed by the feed rollers R1 and R2 is detected by a sensor PS2 provided directly before the resist rollers R3, the rotation of the resist rollers R3 is reversed. Accordingly, the leading edge of the sheet fed by the feed rollers R1 and R2 abuts on the resist rollers R3 and stops temporarily. The feeding timing is therefore adjusted. This process also compensates for the skewing of the sheet.

Then, in accordance with the timing for alignment with the toner image on the photosensitive drum 10, the resist rollers R3 with which the leading edge of the sheet is in contact are rotated forward to start feeding the sheet again. After the sheet is accelerated to the same speed as the rotational speed of the photosensitive drum 10 until the sheet comes to the transfer position of the photosensitive drum 10, the toner image is transferred on the sheet.

Through the above processes, the toner image is transferred on the correct position on the sheet. That is, the sheet once picked up is stopped by the resist rollers R3 near the photosensitive drum 10 to compensate for the positional deviation of the sheet, and the sheet is then fed again in synchronism with the photosensitive drum 10 to be aligned with the toner image of the photosensitive drum 10.

The conventional scheme however has the following shortcomings. First, as sheets are picked up one after another by the pickup rollers in the continuous printing, the resist rollers are stopped after the trailing edge of a preceding sheet is fed out as shown in FIG. 2. The resist rollers should then rotate in the reverse direction to align the leading edge of the next sheet. The minimum time for starting feeding the next sheet is the time required for stopping and then reversing the rotation of the resist rollers. Accordingly, the distance d between the preceding sheet and the next sheet increases as shown in FIG. 2.

It is therefore inevitable that the exposure and developing positions on the photosensitive drum for the next sheet are apart from those for the preceding sheet. This reduces the effective performance of the image formation on the photosensitive drum, thus deteriorating the printing performance.

Secondly, a sheet should be accelerated so that its moving speed would match with the rotational speed of the photosensitive drum while the sheet moves from the resist rollers to the photosensitive drum. The feeding path should thus include a distance from the resist rollers to the photosensitive drum which is necessary for the acceleration of the sheet. If the feeding path is long, the positional deviation is accumulated accordingly as mentioned earlier, making it difficult to align the sheet with the toner image with higher precision.

SUMMARY OF THE INVENTION

It is therefore a primary object of the present invention to provide an image forming apparatus which will compensate for the positions of sheets in the feeding direction at the time the sheets are continuously fed.

It is another object of the present invention to provide an image forming apparatus which will continuously feed sheets without stopping the sheets.

It is a further object of the present invention to provide an image forming apparatus which will continuously feed sheets without reducing the effective performance of image formation.

According to one aspect of the present invention, there is provided an image forming apparatus comprising:

an endless type rotatable image forming body;

image forming means for forming an image on the image forming body;

transfer means for transferring the image on the image forming body onto a sheet being fed;

feeding means for feeding the sheet;

first detecting means for detecting the sheet being fed at a first predetermined position in a feeding path of the sheet;

second detecting means, located on a side of the transfer means at a second predetermined position, for detecting the sheet being fed; and control means for controlling a feeding speed of the feeding means to compensate for a transfer position of the sheet, in accordance with a measured feeding time from the first predetermined position to the second predetermined position based on outputs of the first and second detecting means.

According to the present invention, the second detecting means for detecting the passage of a sheet which is fed toward the upstream side of the transfer means in the feeding path is provided. The control means measures the feeding time of the sheet from a predetermined position to the position of the detection, based on the output of the second detecting means. Further, the control means compares this feeding time with a specified time from the predetermined position to the position of the detection to detect a positional deviation. In accordance with the difference between the measured feeding time and the specified time, the control means controls the feeding speed of the feeding means to thereby compensate for the positional deviation.

This design can compensate for a positional deviation without stopping the movement of a sheet, so that the distance between sheets can be reduced. This shortens the distance to the next image forming position on the image forming body, thus improving the printing performance. Further, as the distance between sheets is shortened, images will be formed faster accordingly.

Furthermore, since a speed variation at the time of continuous sheet feeding will become very small as compared with the prior art, it is possible to suppress the feeding distance required for a sheet to reach the rotational speed of the image forming body. As a result, the accuracy of the alignment of a sheet with its associated toner image can be further improved.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
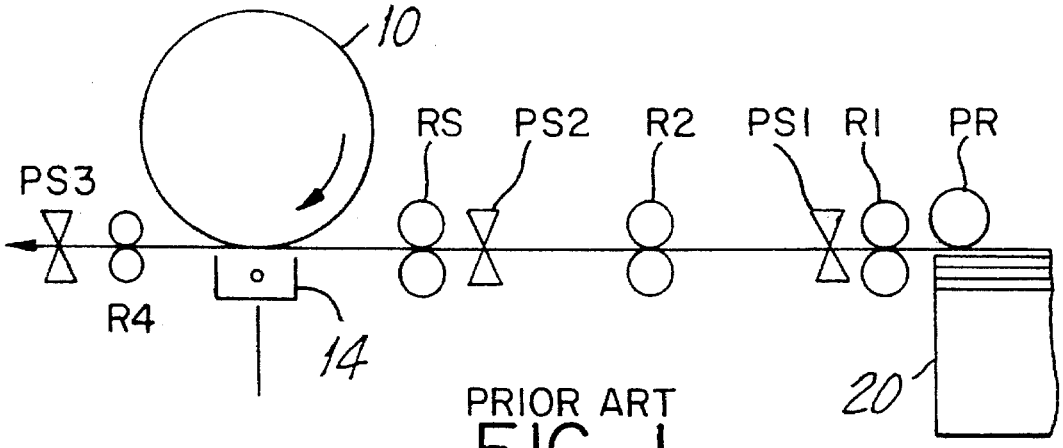
PRIOR ART FIG. 1
FIG. 1 is a structural diagram of a conventional image forming apparatus.
Figure 2:
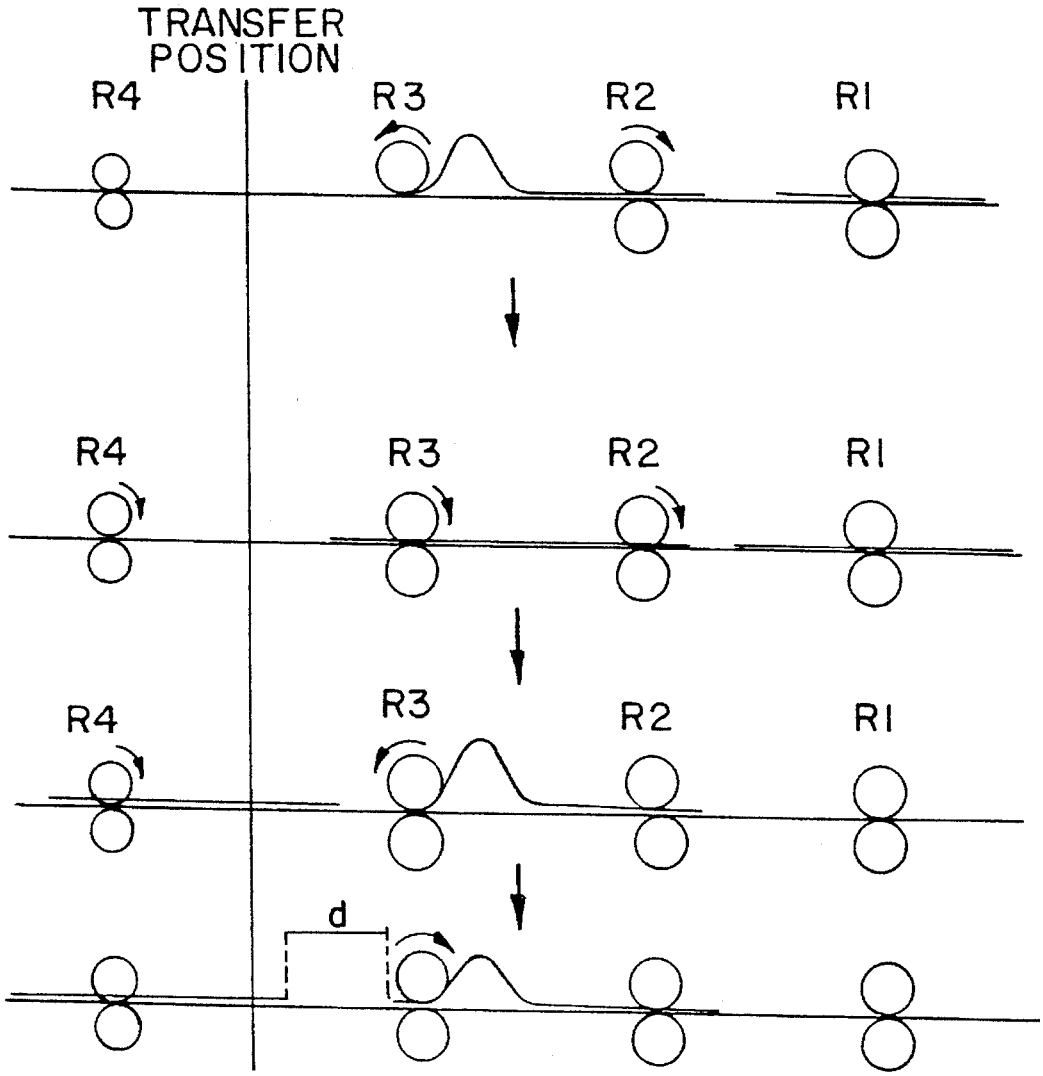
PRIOR ART FIG. 2
FIG. 2 is an explanatory diagram for a conventional sheet feeding operation.
Figure 3:
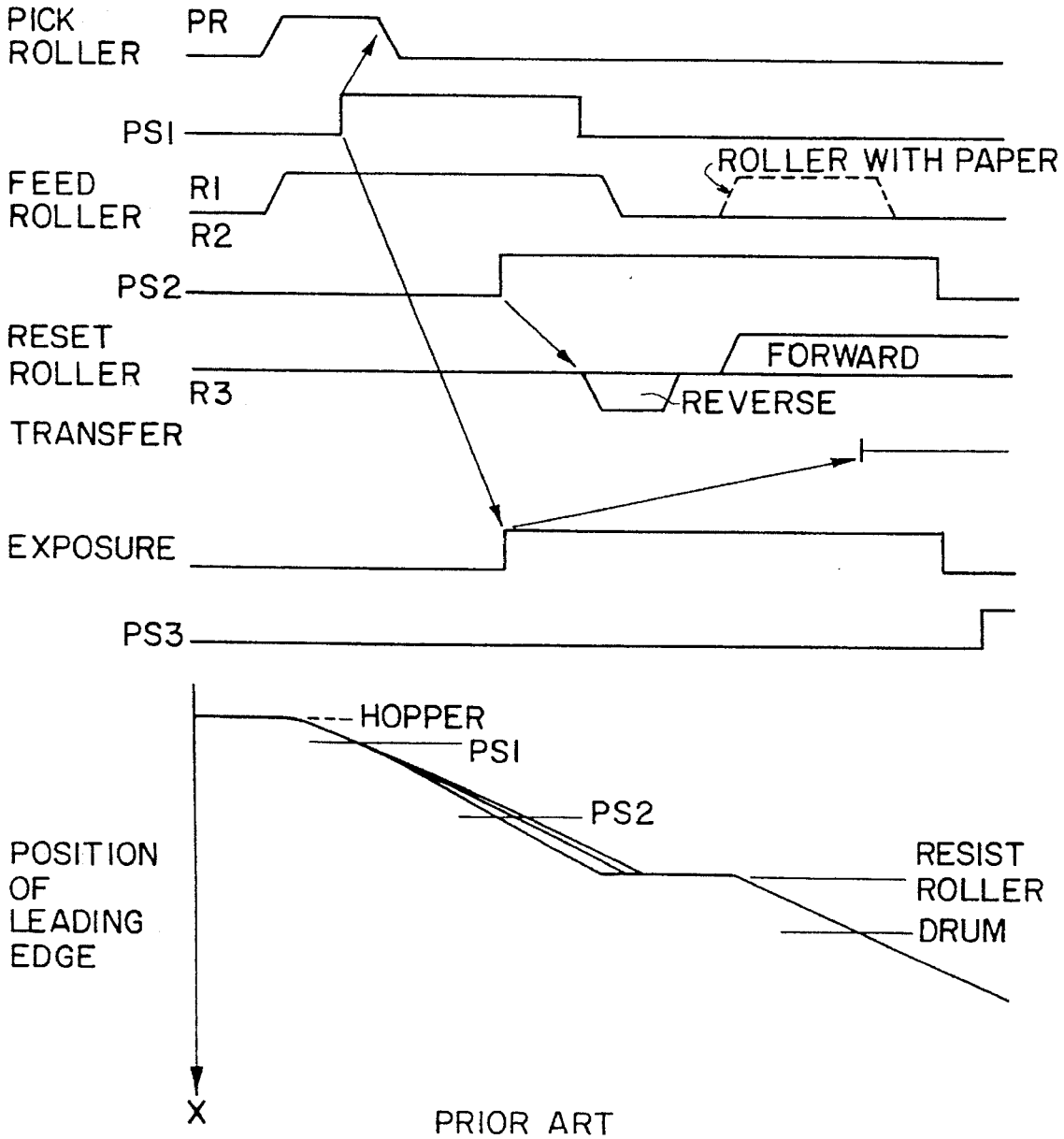
PRIOR ART FIG. 3
FIG. 3 is a time chart for the conventional sheet feeding operation.
Figure 4:
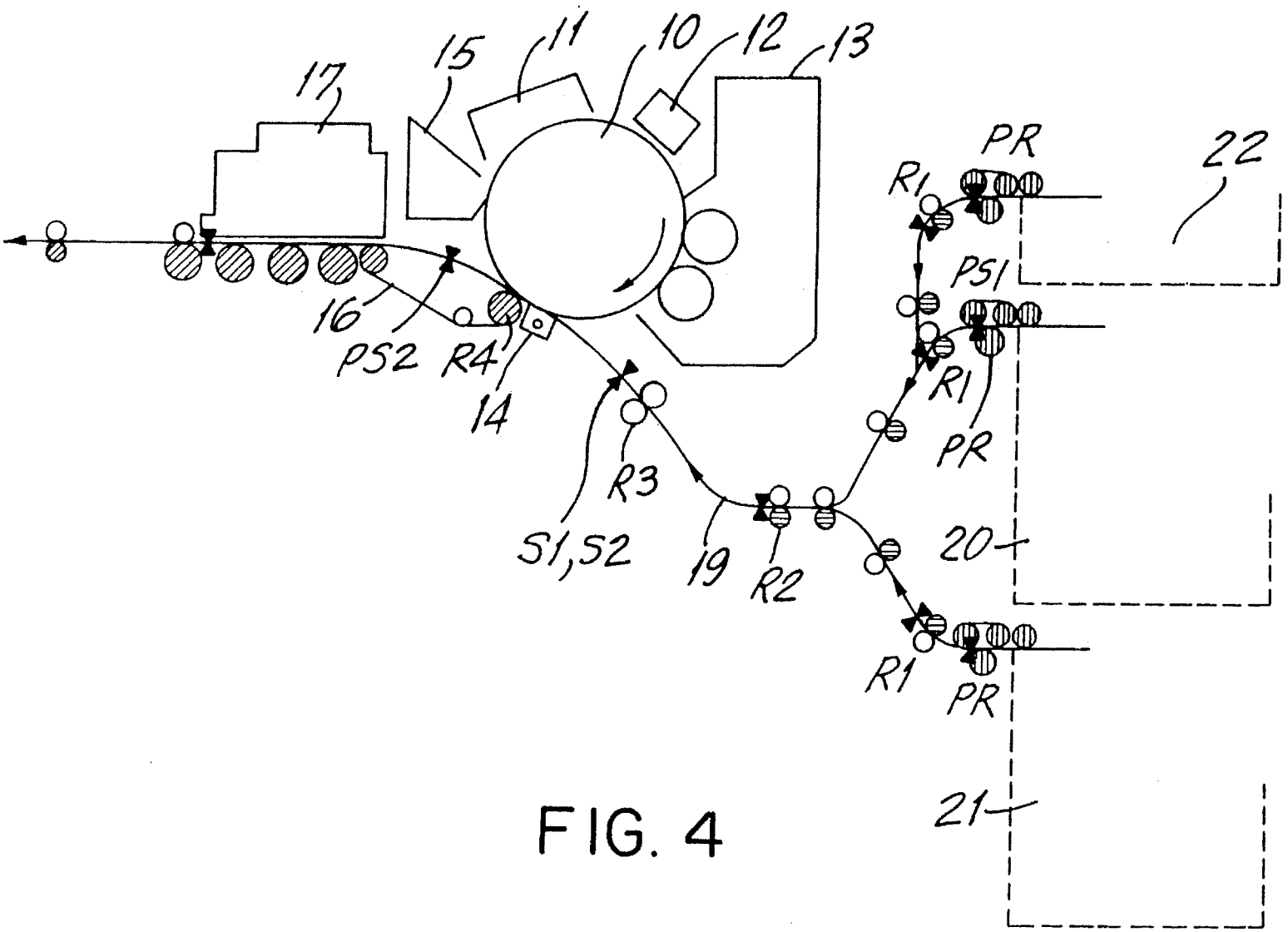
FIG. 4 is a structural diagram of an image forming apparatus according to one embodiment of the present invention.
Figure 5:
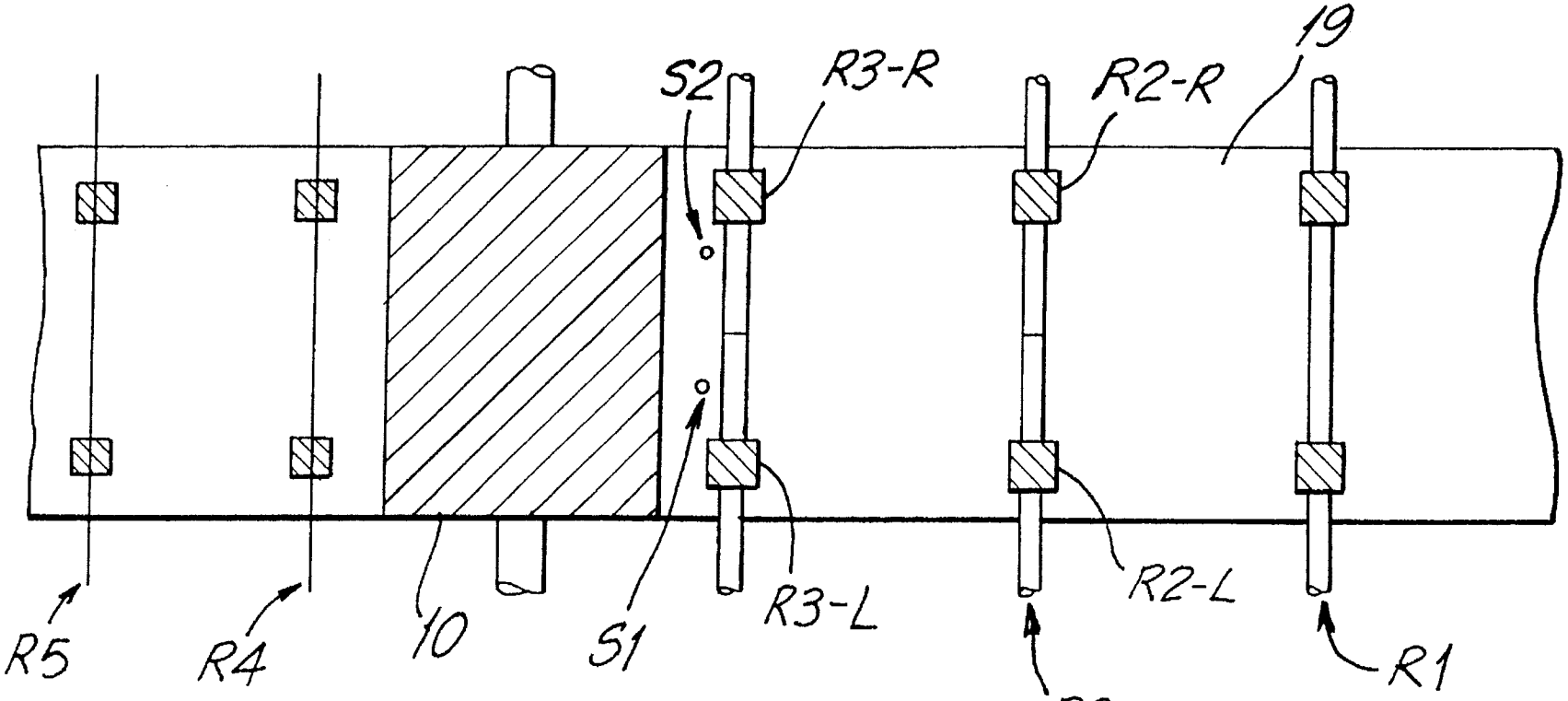
FIG. 5 is a top view of a feeding path in FIG. 4.

FIG. 4 is a structural diagram of an image forming apparatus according to one embodiment of the present invention, and FIG. 5 is a top view of a feeding path of the apparatus of FIG. 4.

In FIG. 4, a photosensitive drum 10 has a photoconductive layer provided around a metal drum, and rotates in the arrowhead direction. A precharger 11 serves to uniformly charge the photosensitive drum 10. An LED optical system 12 exposes the photosensitive drum 10 with an optical image to form an electrostatic latent image on the photosensitive drum 10.

A developing unit 13 supplies a developer to the photosensitive drum 10 and develops the electrostatic latent image with the developer to form a toner image. A transfer unit 14 transfers the toner image on the photosensitive drum 10 onto a sheet that is fed there. A de-electrifier and cleaner 15 removes residual charges from the photosensitive drum 10, and cleans off the residual toners. An attraction belt 16 separates the image-transferred sheet from the photosensitive drum 10 and feeds the sheet onward. A fixing unit 17, which is a flash fixing unit, fixes the toner image, transferred on the sheet, with flash light.

A feeding path 19 is a path along which sheets are to be conveyed. There are two hoppers 20 and 21 and one cassette 22, located at the top. The middle and bottom hoppers 20 and 21 and the top cassette 22 all serve to retain unused or unprinted sheets.

Individual pickup rollers PR are provided to pick up sheets from the middle and bottom hoppers 20 and 21 and the top cassette 22. A pickup sensor PS1 detects that a sheet is picked up by the pickup rollers PR. Feed rollers R1 feed the picked sheet. Reference numerals "R2," "R3" and "R4" are also feed rollers for feeding sheets. Sheet passing sensors or sheet sensors S1 and S2 detect a sheet which is conveyed by the feed rollers R3. A sheet separation sensor PS2 detects the sheet on which the toner image on the photosensitive drum 10 has been transferred and from which it has been separated by the attraction belt 16.

As shown in FIG. 5, the structure for feeding sheets along the feeding path 19 has feed rollers R5 in addition to the feed rollers R1, R2, R3 and R4 all arranged at predetermined intervals. Of those feed rollers, the feed rollers R2 and R3 which are close to the transfer position, i.e., the photosensitive drum 10, are separated into right and left feed rollers R2-R and R2-L and R3-R and R3-L, respectively, which are independently driven. The aforementioned sheet sensors S1 and S2 are disposed perpendicular to the feeding direction between the photosensitive drum 10 and the feed rollers R3 which are closest to the drum 10.

The operation of this printer will be described below. A sheet is picked up by the pickup rollers PR and is fed along the feeding path 19 by the feed rollers R1, R2 and R3. The conveyed sheet passes through the sensors PS1, S1 and S2 and reaches the transfer unit 14 where the toner image on the photosensitive drum 10 is transferred onto the sheet. The sheet is then separated from the photosensitive drum 10 to be fed to the fixing unit 17 by the attraction belt 16. The fixing unit 17 fixes the toner image on the sheet with flash light and then feeds the sheet to a stacker.

Figure 6:
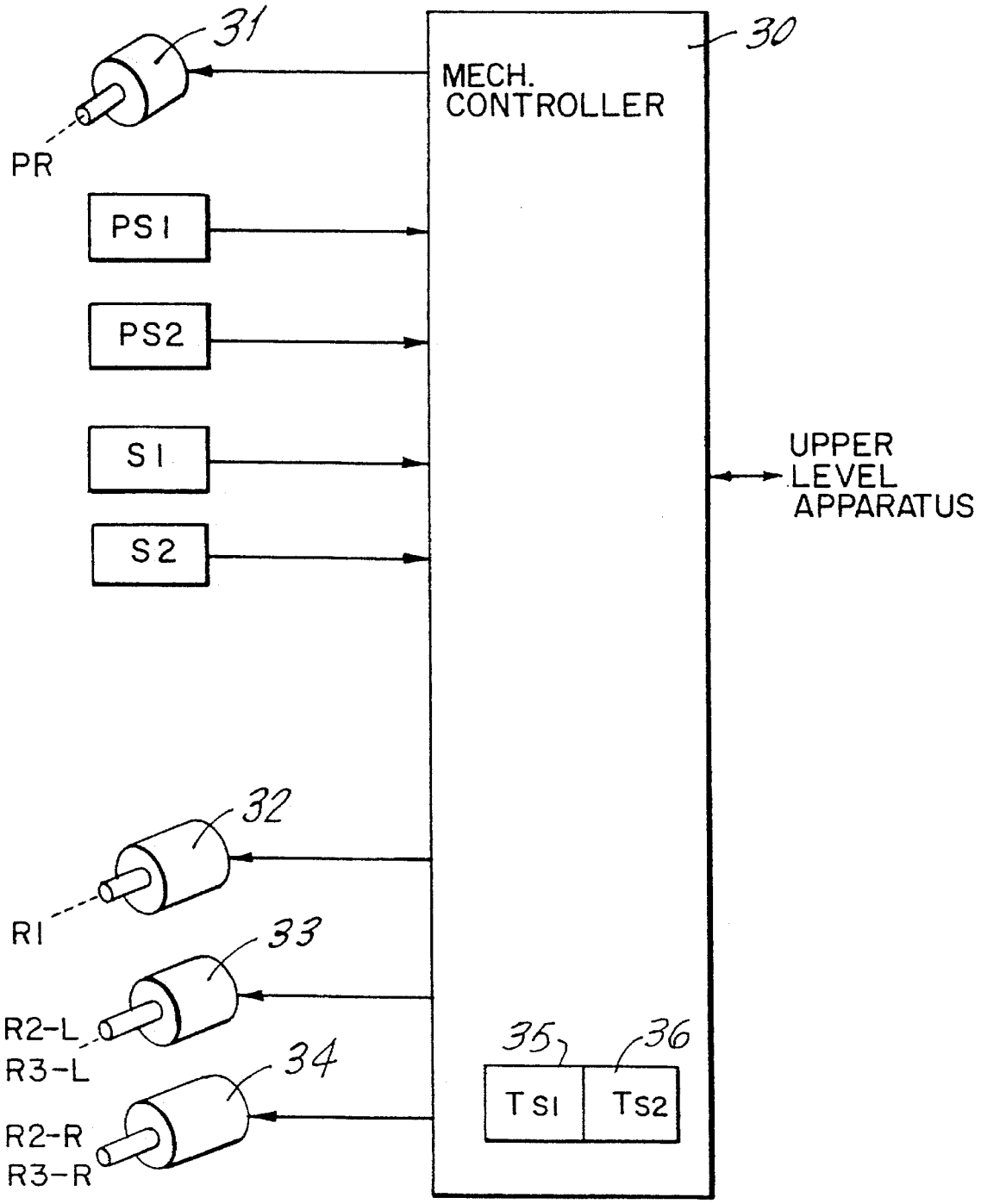
FIG. 6 is a control block diagram of the structure shown in FIG. 4.
Figure 7:
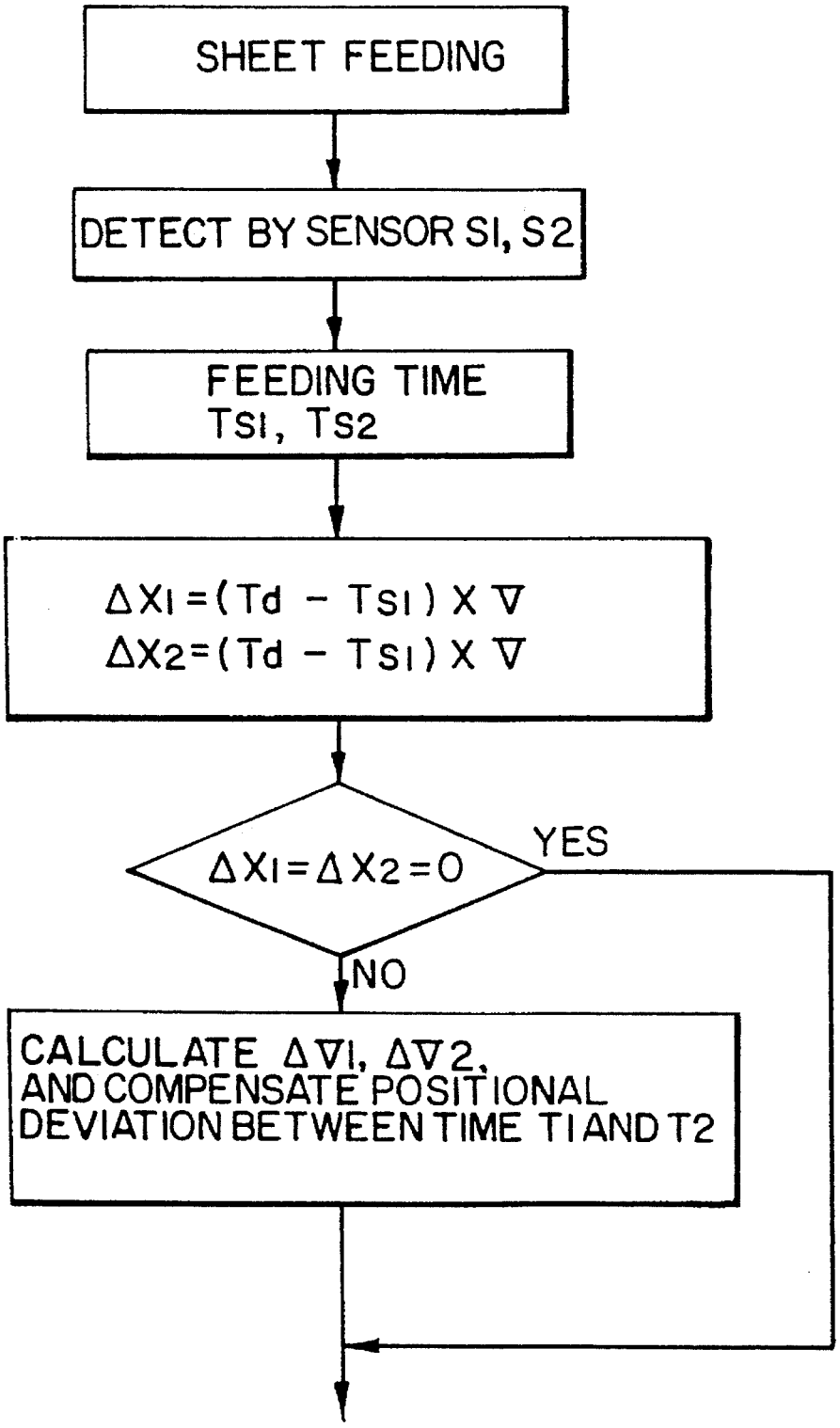
FIG. 7 is a flowchart of a positional-deviation compensating process according to this embodiment.
Figure 8:
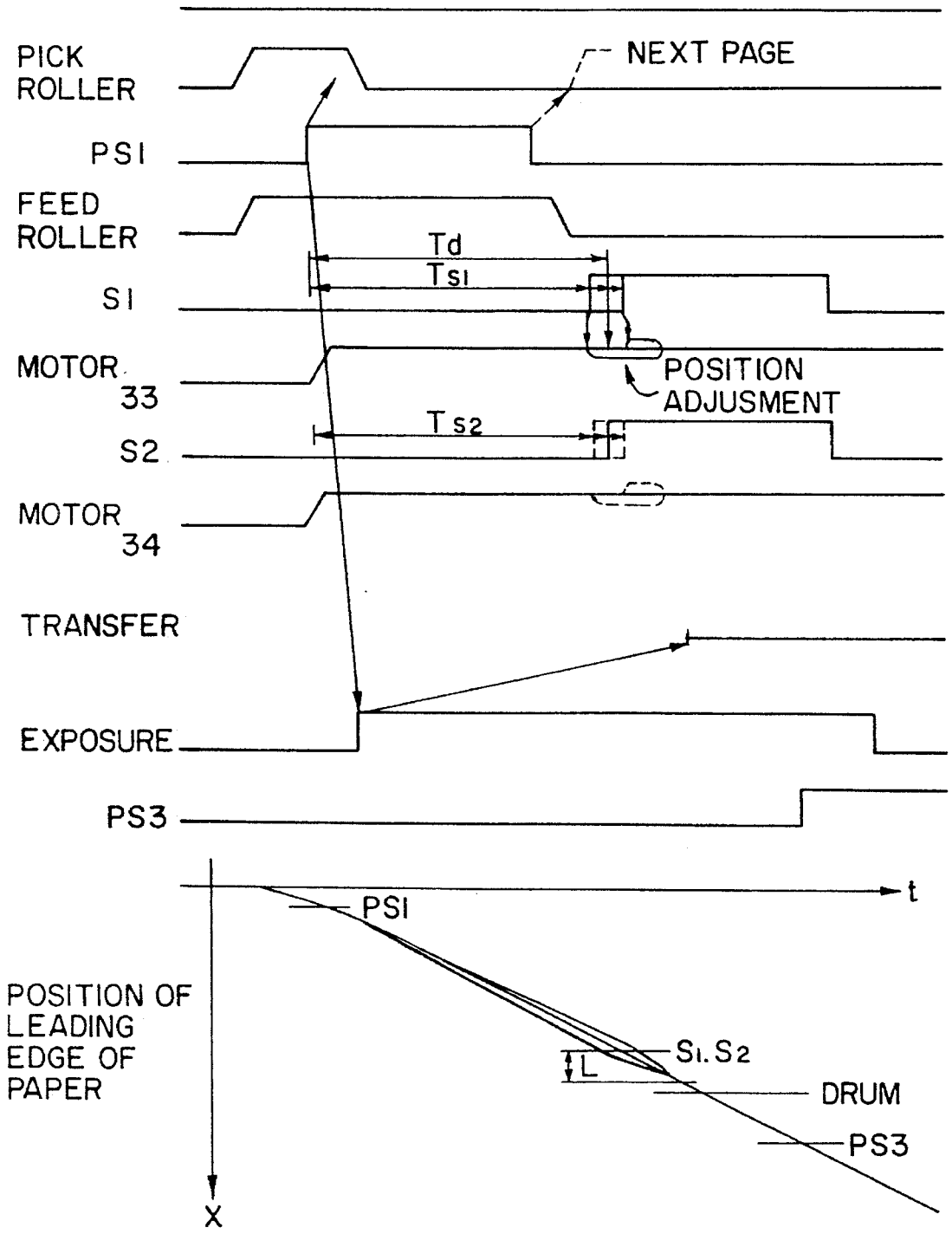
FIG. 8 is a time chart for this embodiment.

FIG. 6 is a control block diagram of the structure shown in FIG. 4; FIG. 7 is a flowchart of a positional-deviation compensating process according to this embodiment; FIG. 8 presents a time chart of the sequence of processes of FIG. 7, and FIGS. 9A to 9E are explanatory operational diagrams for this embodiment.

In FIG. 6, a mechanism controller 30 is constituted of a microprocessor which controls the individual mechanism of the printer. A pickup motor 31 drives the pickup rollers PR when instructed by the controller 30. Reference numerals "PS1" and "PS2" are the aforementioned pickup sensor and sheet separation sensor. Reference numerals "S1" and "S2" are the aforementioned sheet sensors. A first feed motor 32 rotates the feed rollers R1, and a second feed motor 33 rotates the left feed rollers R2-L and R3-L. A third feed motor 34 rotates the right feed rollers R2-R and R3-R.

This mechanism controller 30 controls the drive of the pickup motor 31, the first feed motor 32, the second feed motor 33 and the third feed motor 34, in accordance with outputs of the sensor PS1, sensor PS2, sensor S1 and sensor S2.

The positional deviation control operation will now be described according to the flowchart given in FIG. 7 and with reference to the time chart in FIG. 8 and the explanatory operational diagrams of FIGS. 9A to 9E.

(S1) The mechanism controller (hereinafter called "processor") 30 causes the pickup motor 31 to rotate in accordance with a print instruction from an upper-level apparatus. As a result, the pickup rollers PR rotate to pick up a sheet from the hopper 20. At the same time, the processor 30 causes the first feed motor 32 to rotate the feed rollers R1 at a predetermined speed V. When the sheet is fed out, the pickup sensor PS1 detects the leading edge of the sheet.

When detecting the successful sheet pickup based on the detection output of the pickup sensor PS1, the processor 30 activates a pair of feed-time timers 35 and 36 to start measuring the time. At the same time, the processor 30 rotates the second feed motor 33 and third feed motor 34 to rotate at the predetermined speed V. In synchronism with the detection of sheet pickup, the processor 30 causes the exposure section 12 to start forming an image on the rotating photosensitive drum 10. Accordingly, the sheet is fed toward the transfer position on the photosensitive drum 10 by the feed rollers R1, R2 and R3.

(S2) When detecting the leading edge of the sheet being fed, the sheet sensors S1 and S2 produce sheet detection outputs. Based on those detection outputs, the processor 30 stops the time measuring operation of the feed-time timers 35 and 36. Accordingly, the feeding times Ts1 and Ts2 of the sheet from the pickup sensor PS1 to the sheet sensors S1 and S2 will be measured.

(S3) Then, the processor 30 calculates left and right positional deviations ΔX1 and ΔX2 from the feeding times Ts1 and Ts2. Given that a specified sheet-feeding time from the pickup sensor PS1 to the sheet sensors S1 and S2 is Td and the feeding speed is V, the positional deviations ΔX1 and ΔX2 are given by the following equations:

$$\Delta X1=(Td-Ts1)\times V \quad (1)$$

$$\Delta X2=(Td-Ts2)\times V \quad (2)$$

(S4) The processor 30 then determines if the positional deviations ΔX1 and ΔX2 are zero. If the positional deviations ΔX1 and ΔX2 are both zero, there is no positional deviation so that no positional compensation will be executed.

(S5) If at least one of the positional deviations ΔX1 and ΔX2 is not zero, there is a positional deviation so that the processor 30 computes compensation speeds ΔV1 and ΔV2 to compensate for the left and right positional deviations of the sheet. Since the allowable moving distance L for the compensation is limited by the distance from the sheet sensors S1 and S2 to the transfer position, the compensation speed for compensating for any positional deviation will be calculated during the movement over the distance L. Given that the feeding speed is V, the left and right positional compensation periods are t1 and t2 and the speeds in the deviation compensation periods are v1 and v2, the deviation compensation periods t1 and t2 and the speeds v1 and v2 in the deviation compensation periods are expressed by the following equations.

$$v1=L.V/(L+\Delta X1) \quad (3)$$

$$v2=L.V/(L+\Delta X2) \quad (4)$$

$$t1=L/v1,\ t2=L/v2 \quad (5)$$

Thus, the compensation speeds ΔV1, ΔV2 and the deviation compensation periods t1 and t2 are expressed by the following equations.

$$\Delta V1=-\Delta X1.V/(L+\Delta X1) \quad (6)$$

$$\Delta V2=-\Delta X1.V/(L+\Delta X2) \quad (7)$$

$$t1=(L+\Delta X1)/V,\ t2=(L+\Delta X2)/V \quad (8)$$

Figure 9A:
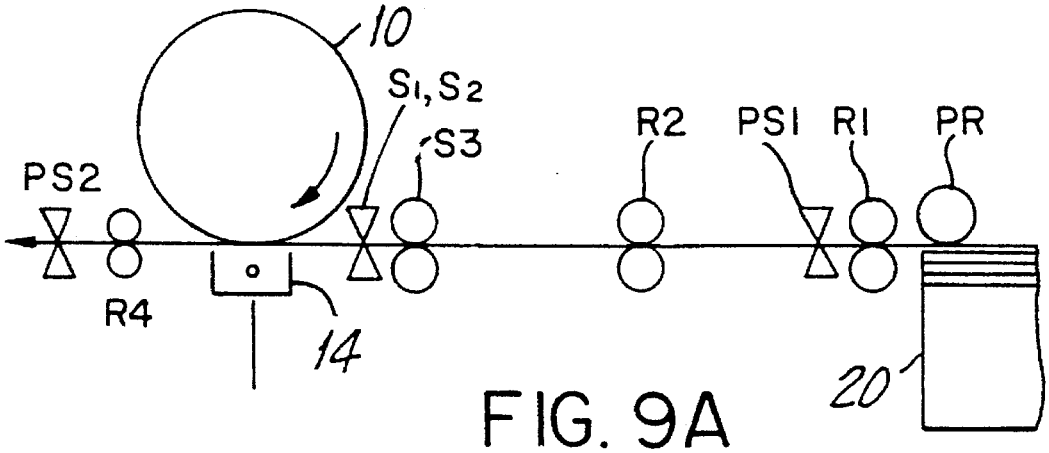
FIGS. 9A through 9E are explanatory diagrams for the process illustrated in FIG. 7.
Figure 9B:
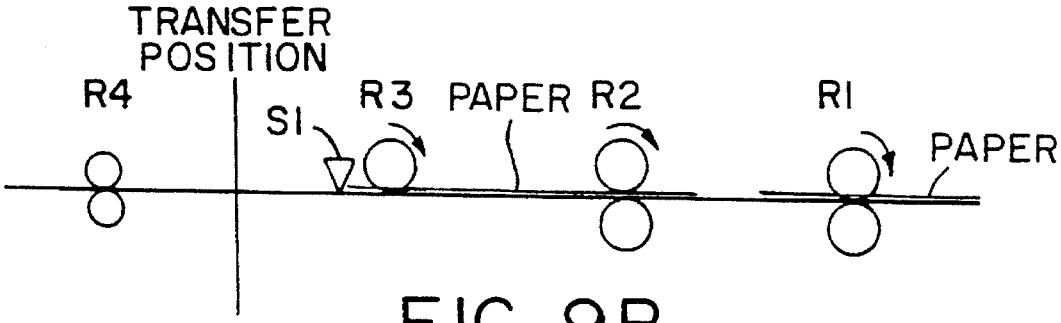
Figure 9C:
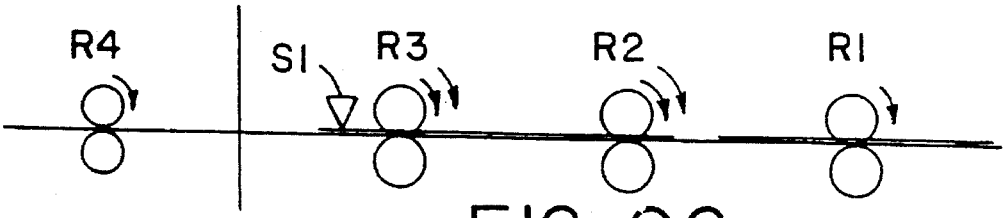
Figure 9D:
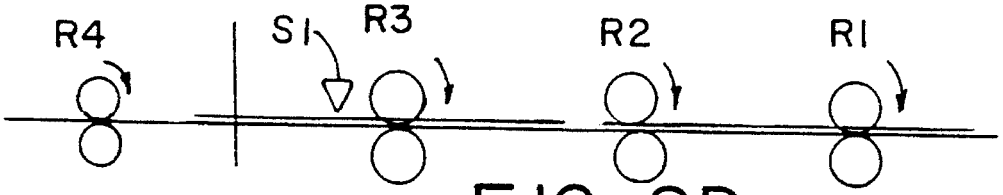

The processor 30 adds the compensation speeds ΔV1 and ΔV2 to the feeding speed V and drives the feed motors 33 and 34 for the periods t1 and t2 (hereinafter generally referred to as "t"). When the sheet position deviates while the sheet moves from the pickup sensor PS1 to the sheet sensors S1 and S2, therefore, the sheet is conveyed at the positional-deviation compensation speeds (V+ΔV1) and (V+ ΔV2) while the sheet moves from the positions of the sheet sensors S1 and S2 to the transfer position at most, as shown in FIGS. 9C and 9D. Therefore, the leading edge of the sheet will be aligned with the leading edge of the image forming position on the photosensitive drum 10 at the transfer position.

Figure 9E:
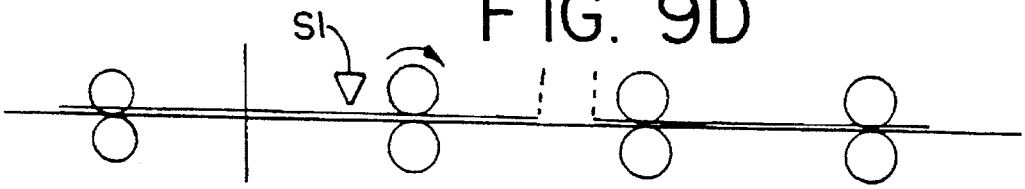

Since the sheet position is compensated during a continuous sheet feeding, the distance d between sheets becomes smaller as shown in FIG. 9E. This can reduce the unused area on the photosensitive drum 10, so that the photosensitive drum 10 will be used efficiently and the printing speed will be improved accordingly.

Further, since the right and left positional deviations of a sheet are detected and the feeding speeds for the right and left sides of the sheet are changed according to the detection outputs in this example, skewing of the sheet will also be compensated. As the feeding speeds of the feed rollers R2 and R3 on the transfer position side are compensated, the compensation operation will not affect the next sheet.

Because the compensation control is performed by the feed rollers of the feeding means which are closest to the transfer position, the positional alignment can be executed in the vicinity of the transfer position, ensuring the correct positional alignment.

Figure 10:
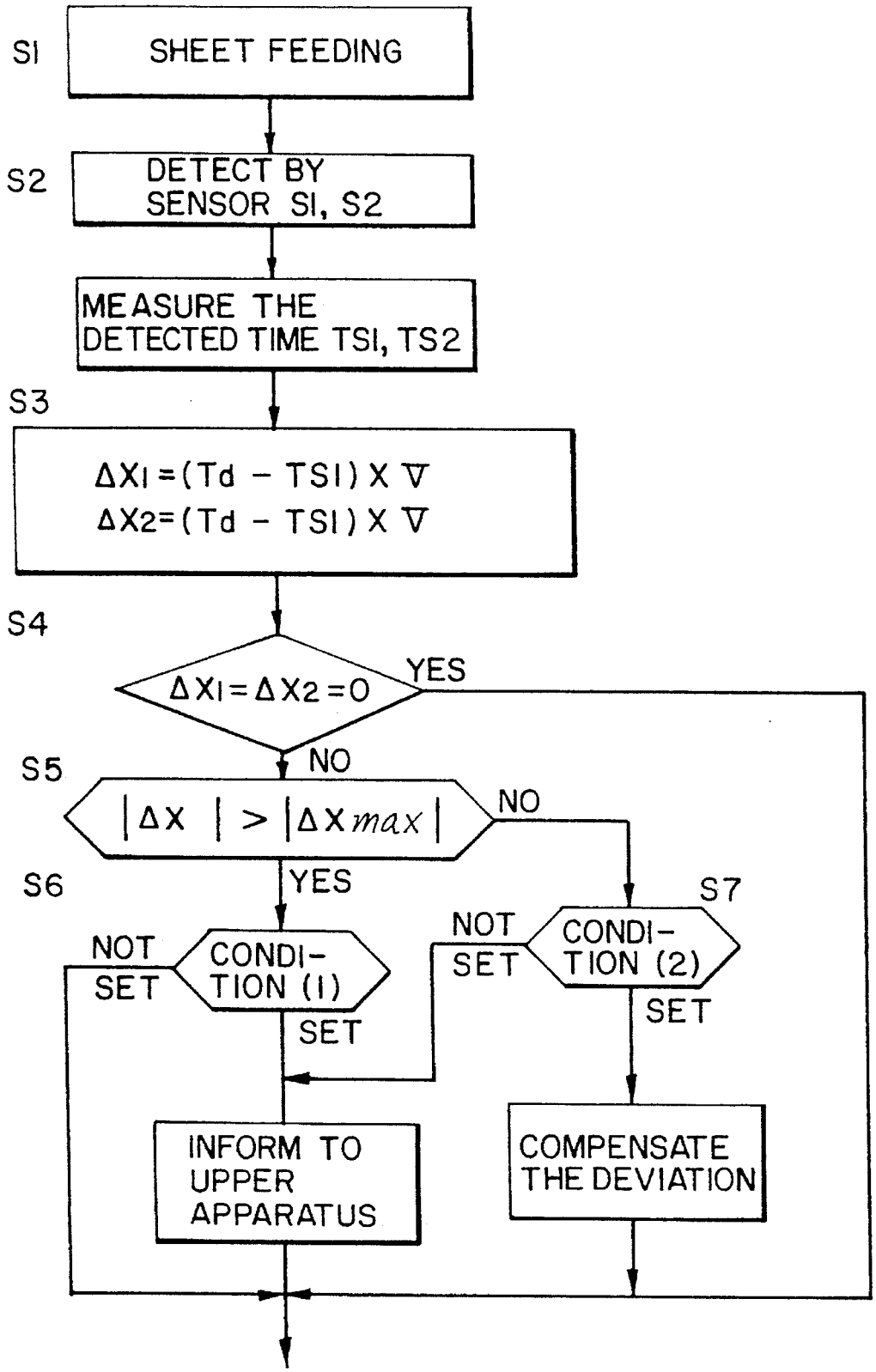
FIG. 10 is a flowchart of a positional-deviation compensating process according to a first modification of the present invention.

FIG. 10 presents a flowchart of a positional-deviation compensating process according to a first modification of the present invention.

This embodiment is the above-described embodiment which further includes a process for the case where there occurs an uncompensatable positional deviation occurs. As steps S1 to S4 are the same as those of the previous embodiment, the flow starting at step S5 will be discussed below.

(S5) If at least one of the positional deviations ΔX1 and ΔX2 is not zero, there is a positional deviation. Therefore, the processor 30 first compares the absolute values |ΔX1| and |ΔX21| of the positional deviations ΔX1 and ΔX2 with the maximum compensatable value |Xmax|.

(S6) When the absolute values |ΔX1| and |ΔX2| of the positional deviations are larger than the maximum compensatable value |ΔXmax|, the processor 30 determines that compensation is not possible. The processor 30 then checks a condition 1 set in the apparatus. The condition 1 is to instruct the processor 30 to inform the upper-level apparatus of the occurrence of an uncompensatable positional deviation.

If the condition 1 is set, the processor 30 informs the upper-level apparatus of the occurrence of such an event and will not execute positional compensation. When the condition 1 is not set, the processor 30 will neither inform the upper-level apparatus nor carry out positional compensation.

(S7) When the absolute values |ΔX1| and |ΔX2| of the positional deviations are not larger than the maximum compensatable value |ΔXmax|, the processor 30 determines that compensation is possible. The processor 30 then checks a condition 2 set in the apparatus. The condition 2 is to instruct the processor 30 to perform positional compensation when the compensation is possible.

If the condition 2 is set, the processor 30 computes the aforementioned positional compensation speeds ΔV1 and ΔV2 from the equations (6) and (7). The processor 30 adds the compensation speeds ΔV1 and ΔV2 to the feeding speed V and drives the feed motors 33 and 34 for the periods t. When the sheet position deviates while the sheet moves from the pickup sensor PS1 to the sheet sensors S1 and S2, therefore, the sheet is conveyed at the positional-deviation compensation speeds (V+ΔV1) and (V+ΔV2) while the sheet moves from the positions of the sheet sensors S1 and S2 to the transfer position at most. Therefore, the leading edge of the sheet will be aligned with the leading edge of the image forming position on the photosensitive drum 10 at the transfer position.

When the condition 2 is not set, the processor 30 does not carry out positional compensation, and informs the upper-level apparatus of no positional compensation being executed.

As the occurrence of an uncompensatable positional deviation is reported to the upper-level apparatus, a proper measure will be taken even if no positional compensation is possible. When positional compensation is to be skipped even if the compensation is possible, such will be reported to the upper-level apparatus. A proper measure will be taken in this case too.

As mentioned above, there may be a case where positional alignment cannot be performed timely in continuous sheet feeding. If no positional compensation for the misalignment of a sheet is possible, the attempt to compensate for the positional deviation is wasteful so that no positional compensation will be performed. Instead, this situation will be reported to the upper-level apparatus to suggest a recovery process.

Figure 11:
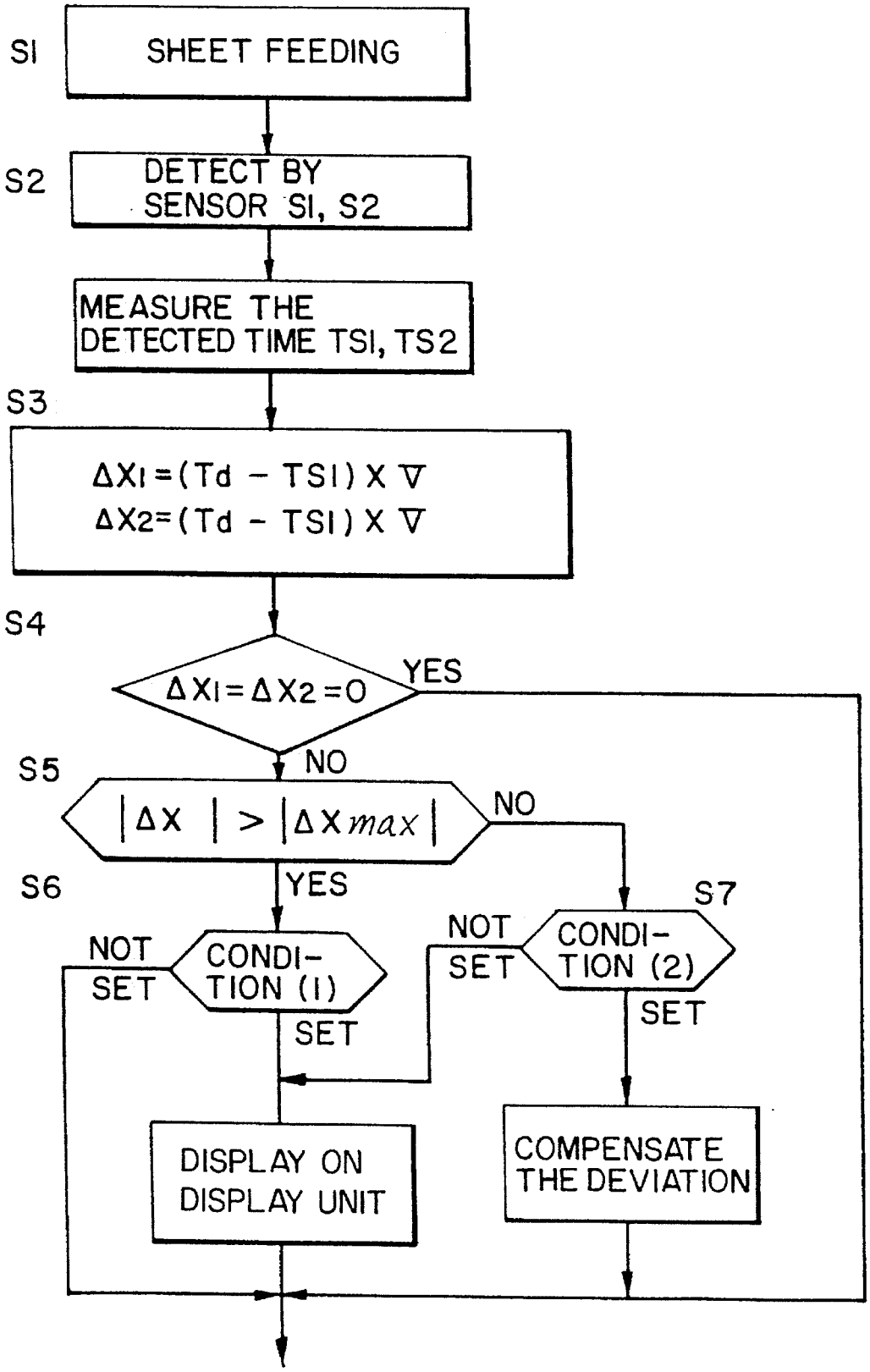
FIG. 11 is a flowchart of a positional-deviation compensating process according to a second modification of the present invention.

FIG. 11 presents a flowchart of a positional-deviation compensating process according to a second modification of the present invention.

This embodiment is the above-described first embodiment which further includes a process for the case where there occurs an uncompensatable positional deviation occurs. Instead of informing the upper-level apparatus of the occurrence of such a case as in the first modification, this occurrence of the event will be displayed on a display unit of the apparatus to inform an operator of the current situation. As steps S1 to S4 in this modification are also the same as those of the first embodiment as in the first modification, the flow starting at step S5 will be discussed below.

(S5) If at least one of the positional deviations ΔX1 and ΔX2 is not zero, there is a positional deviation. Therefore, the processor 30 first compares the absolute values |ΔX1| and |ΔX2| of the positional deviations ΔX1 and ΔX2 with the maximum compensatable value |ΔXmax|.

(S6) When the absolute values |ΔX1| and |ΔX2| of the positional deviations are larger than the maximum compensatable value |ΔXmax|, the processor 30 determines that compensation is not possible. The processor 30 then checks whether or not a condition 1 set in the apparatus. The condition 1 is to instruct the processor 30 to display the occurrence of an uncompensatable positional deviation on the display unit of the apparatus.

If the condition 1 is set, the processor 30 displays the occurrence of such an event on the display unit and will not execute positional compensation. When the condition 1 is not set, the processor 30 will neither indicate the occurrence of such an event on the display unit nor carry out positional compensation.

(S7) When the absolute values |ΔX1| and |ΔX2| of the positional deviations are not larger than the maximum compensatable value |ΔXmax|, the processor 30 determines that compensation is possible. The processor 30 then checks whether or not a condition 2 set in the apparatus. The condition 2 is to instruct the processor 30 to perform positional compensation when the compensation is possible.

If the condition 2 is set, the processor 30 computes the aforementioned positional compensation speeds ΔV1 and ΔV2 from the equations (6) and (7). The processor 30 adds the compensation speeds ΔV1 and ΔV2 to the feeding speed V and drives the feed motors 33 and 34 for the periods t. When the sheet position deviates while the sheet moves from the pickup sensor PS1 to the sheet sensors S1 and S2, therefore, the sheet is conveyed at the positional-deviation compensation speeds (V+ΔV1) and (V+ΔV2) while the sheet moves from the positions of the sheet sensors S1 and S2 to the transfer position at most. Therefore, the leading edge of the sheet will be aligned with the leading edge of the image forming position on the photosensitive drum 10 at the transfer position.

When the condition 2 is not set, the processor 30 does not carry out positional compensation and indicates on the display that no positional compensation will be executed.

As the occurrence of an uncompensatable positional deviation is displayed on the display unit, a proper measure will be taken even if no positional compensation is possible. When positional compensation is to be skipped even if the compensation is possible, such will be indicated on the display unit. A proper measure will be taken in this case too. In other words, the occurrence of an uncompensatable positional deviation is indicated on the display unit to suggest a recovery process to the operator.

Figure 12:
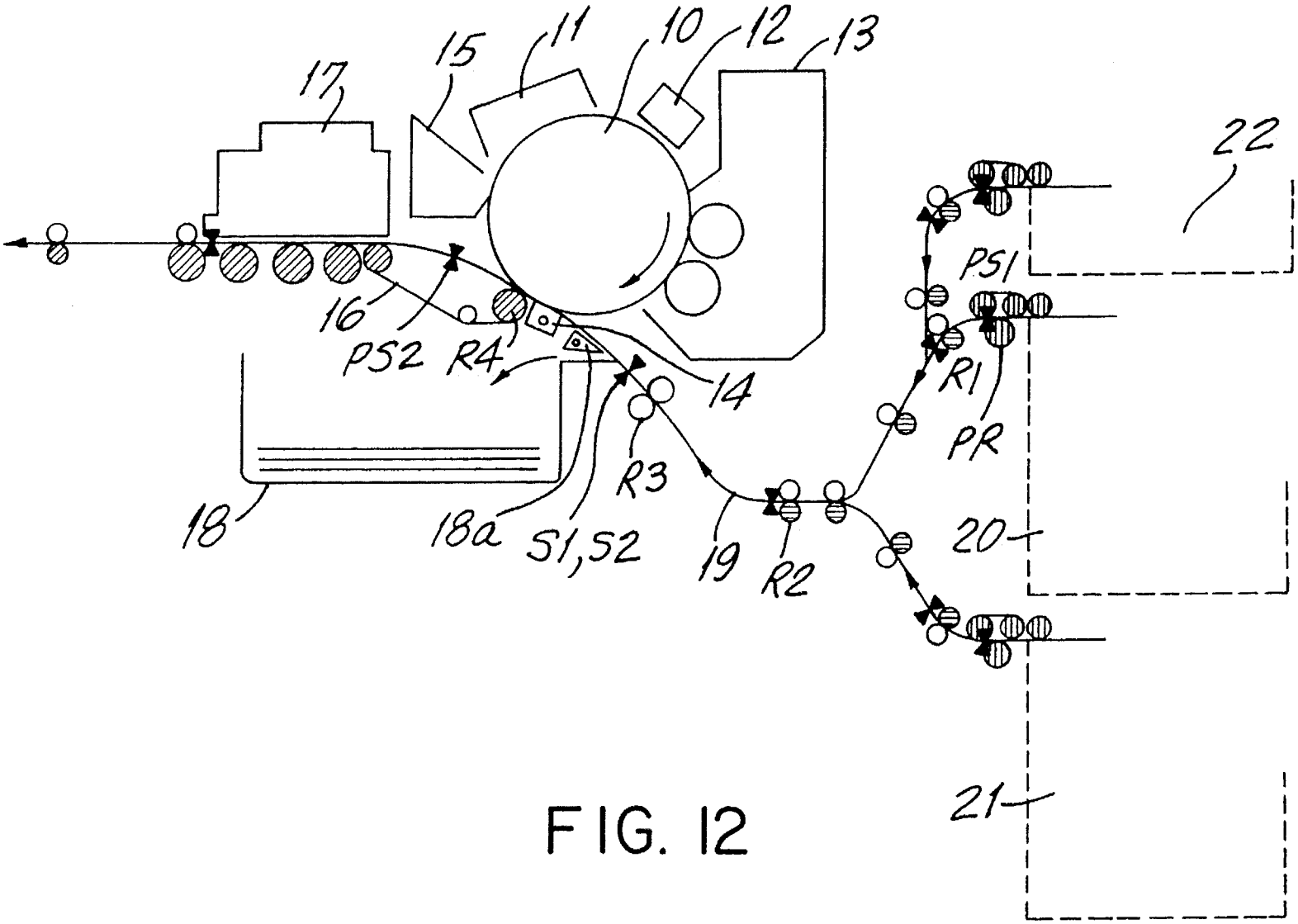
FIG. 12 is a structural diagram of an image forming apparatus according to a third modification of the present invention.
Figure 13:
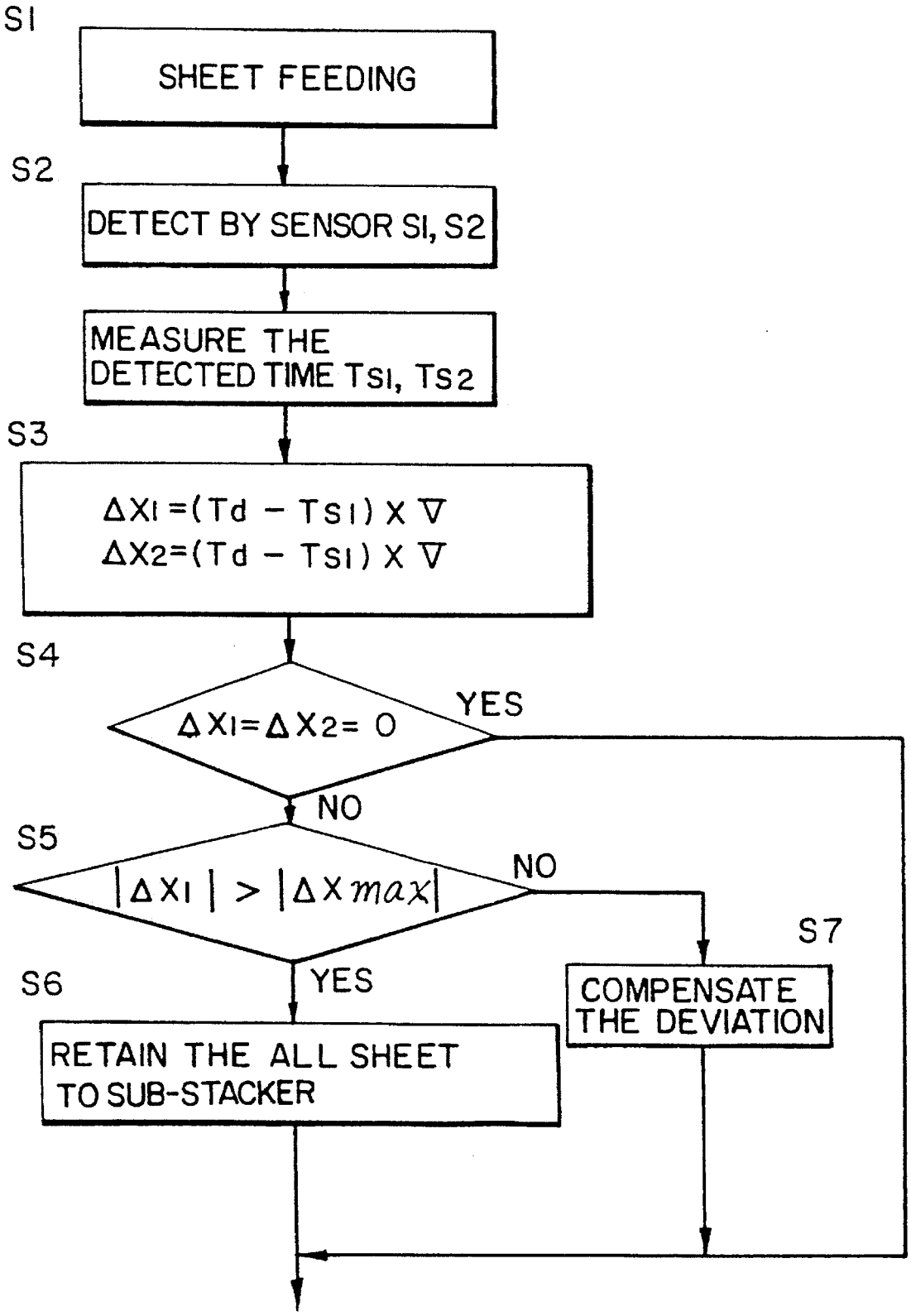
FIG. 13 is a flowchart of a positional-deviation compensating process of the structure shown in FIG. 12.

FIG. 12 is a structural diagram of an image forming apparatus according to a third modification of the present invention, and FIG. 13 presents a flowchart of a positional-deviation compensating process according to the modification in FIG. 12.

FIG. 12 uses the same reference numerals as used in FIG. 4 to denote identical or corresponding structural components. A sub-stacker 18 retains uncompensatable sheets. A switching valve (distributing mechanism) 18*a* is provided between the feed rollers R3 and the transfer unit 14 to guide a sheet to the sub-stacker 18.

This modification is the above-described first embodiment to which a process for the case where there an uncompensatable positional deviation occurs is added. Instead of informing the upper-level apparatus of the occurrence of such an event as in the first modification, the uncompensatable sheet will be retained in the sub-stacker 18. As steps S1 to S4 in this modification are also the same as those of the first embodiment, the flow starting at step S5 will be discussed below.

(S5) If at least one of the positional deviations ΔX1 and ΔX2 is not zero, there is a positional deviation. Therefore, the processor 30 first compares the absolute values |ΔX1| and |ΔX2| of the positional deviations ΔX1 and ΔX2 with the maximum compensatable value |ΔXmax|.

(S6) When the absolute values |ΔX1| and |ΔX2| of the positional deviations are larger than the maximum compensatable value |ΔXmax|, the processor 30 determines that compensation is not possible. The processor 30 then activates the switching valve 18*a* to retain the sheet from the feed rollers R3 to the sub-stacker 18.

(S7) When the absolute values |ΔX1| and |ΔX2| of the positional deviations are not larger than the maximum compensatable value |ΔXmax|, the processor 30 determines that compensation is possible. The processor 30 then computes the aforementioned positional compensation speeds ΔV1 and ΔV2 from the equations (6) and (7).

The processor 30 adds the compensation speeds ΔV1 and ΔV2 to the feeding speed V and drives the feed motors 33 and 34 for the periods t. When the sheet position deviates while the sheet moves from the pickup sensor PS1 to the sheet sensors S1 and S2, therefore, the sheet is conveyed at the positional-deviation compensation speeds (V+ΔV1) and (V+ΔV2) while the sheet moves from the positions of the sheet sensors S1 and S2 to the transfer position at most. Therefore, the leading edge of the sheet will be aligned with the leading edge of the image forming position on the photosensitive drum 10 at the transfer position.

As a sheet is retained in the sub-stacker 18 when no positional compensation is possible, it is possible to prevent wasteful use of sheets and allow for the re-usage of uncompensatable sheets.

Figure 14:
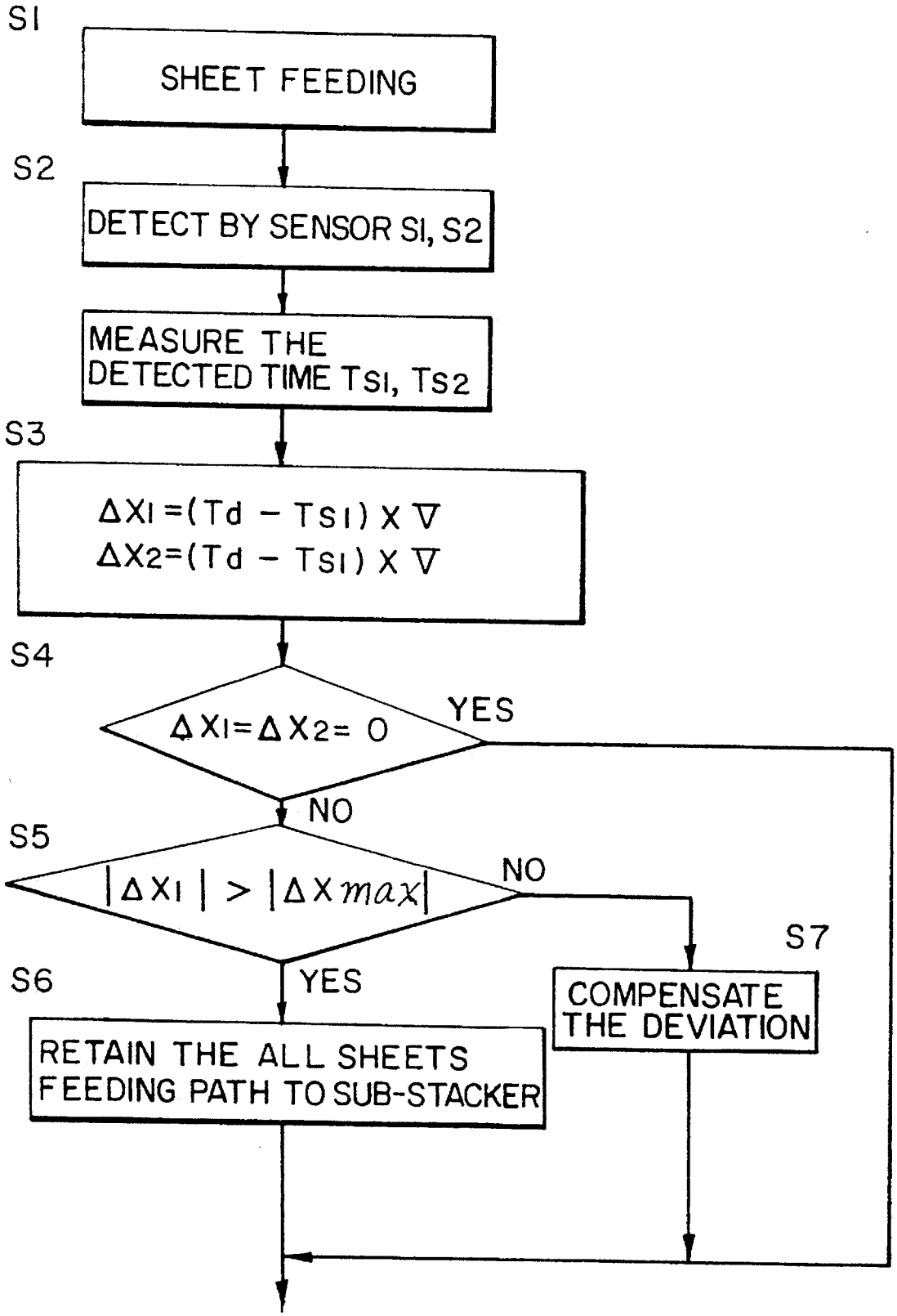
FIG. 14 is a flowchart of a positional-deviation compensating process according to a fourth modification of the present invention.

FIG. 14 presents a flowchart of a positional-deviation compensating process according to a fourth modification of the present invention.

This modification is the above-described first embodiment to which a process for the case where there occurs an uncompensatable positional deviation occurs is added. Instead of informing the upper-level apparatus of the occurrence of such an event as in the first modification, all the sheets on the feeding path will be retained in the sub-stacker 18.

As steps S1 to S5 and S7 in this modification are also the same as those of the third modification, step S6 will be discussed below.

(S6) When the absolute values |ΔX1| and |ΔX2| of the positional deviations are larger than the maximum compensatable value |ΔXmax|, the processor 30 determines that compensation is not possible. The processor 30 then stops the sheet pickup operation. Further, the processor 30 activates the switching valve 18*a* to retain all the sheets on the feeding path to the sub-stacker 18.

As all the sheets on the feeding path are retained in the sub-stacker 18 when no positional compensation is possible, it is possible to prevent wasteful use of sheets and allow for the re-usage of uncompensatable sheets. Further, not only the uncompensatable sheet but all the sheets on the feeding path are retained in the sub-stacker 18, which is suitable for the re-execution of the printing cycle.

Figure 15:
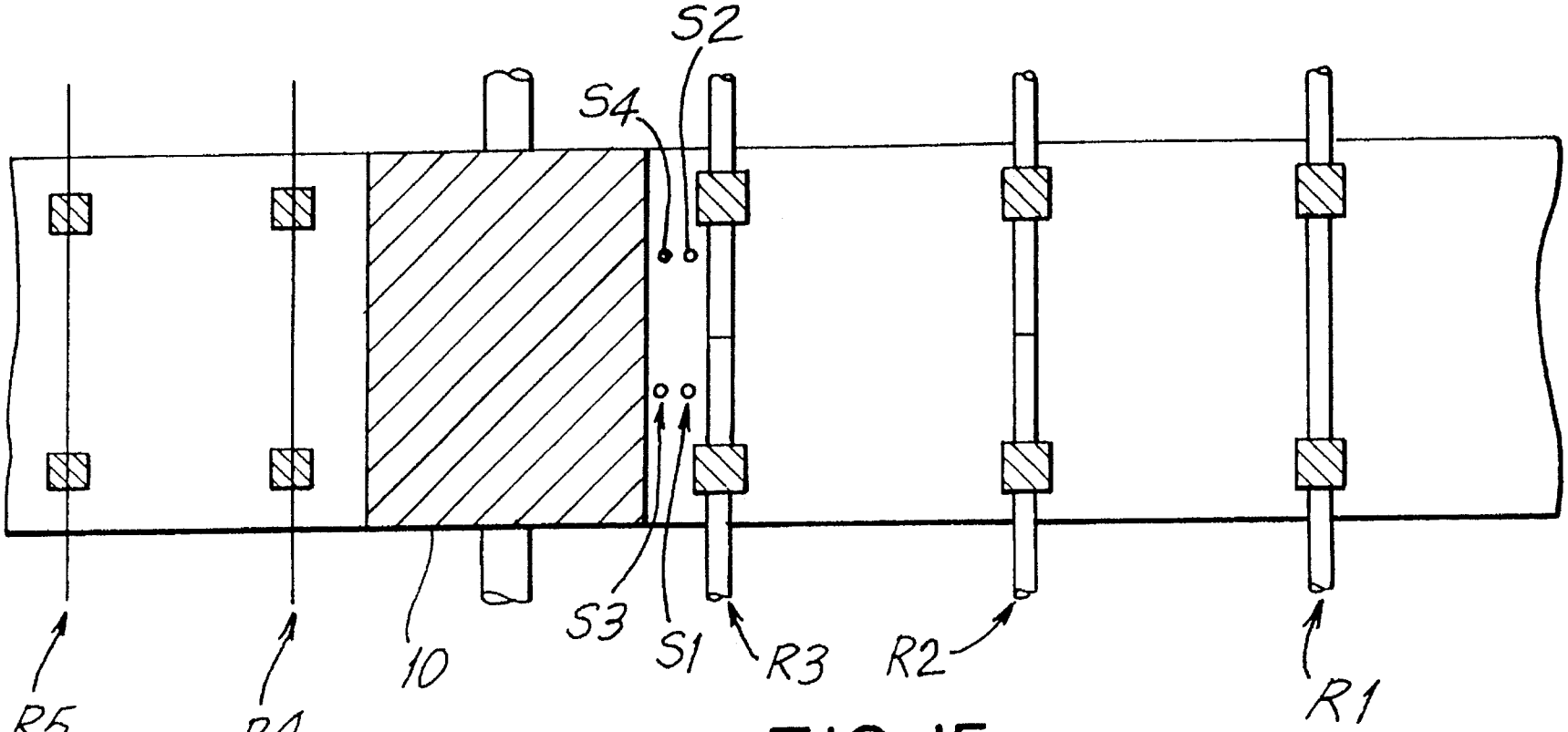
FIG. 15 is a top view of a feeding path according to a fifth modification of the present invention.
Figure 16:
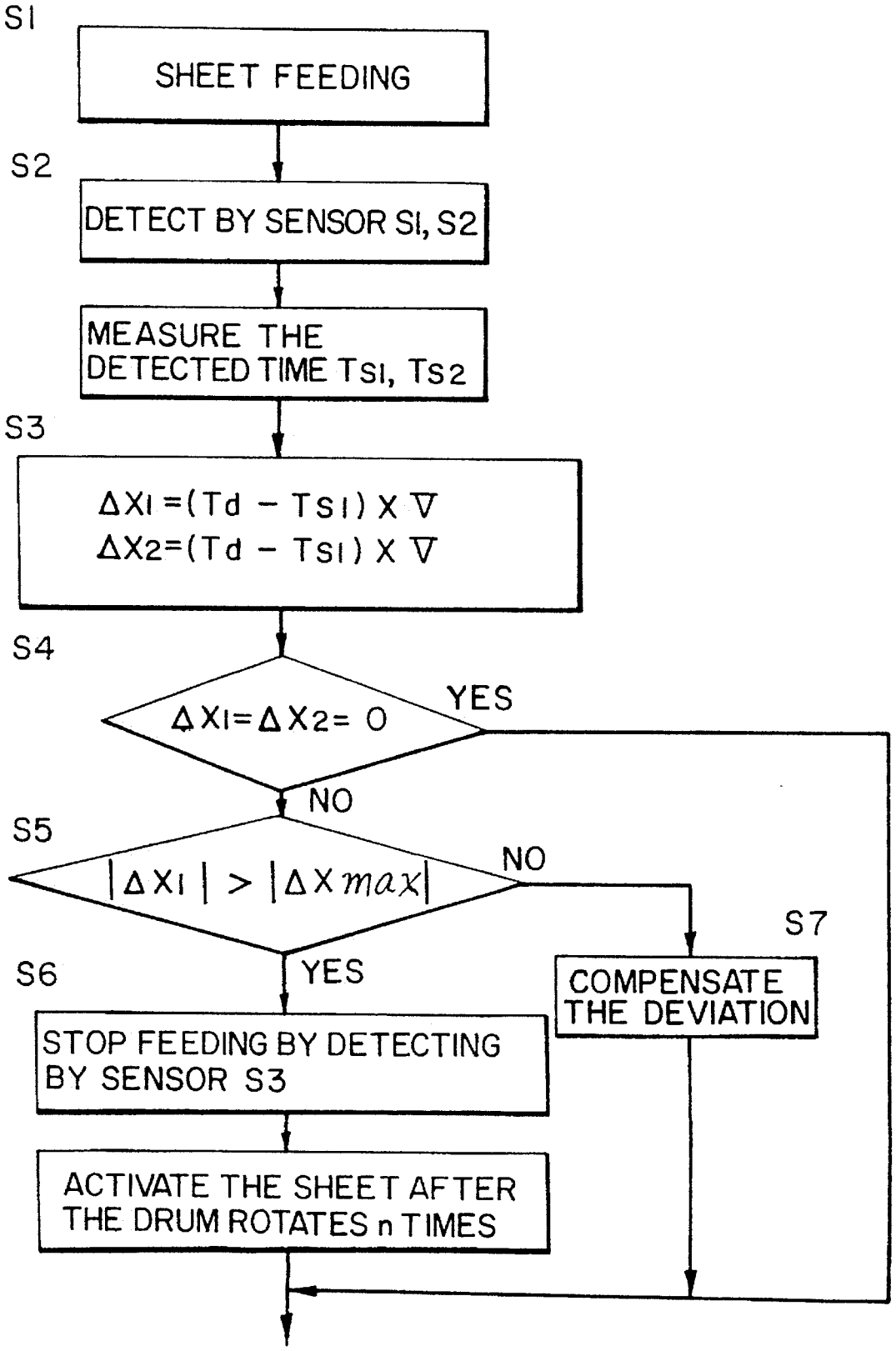
FIG. 16 is a flowchart of a positional-deviation compensating process of the modification shown in FIG. 15.
Figure 17:
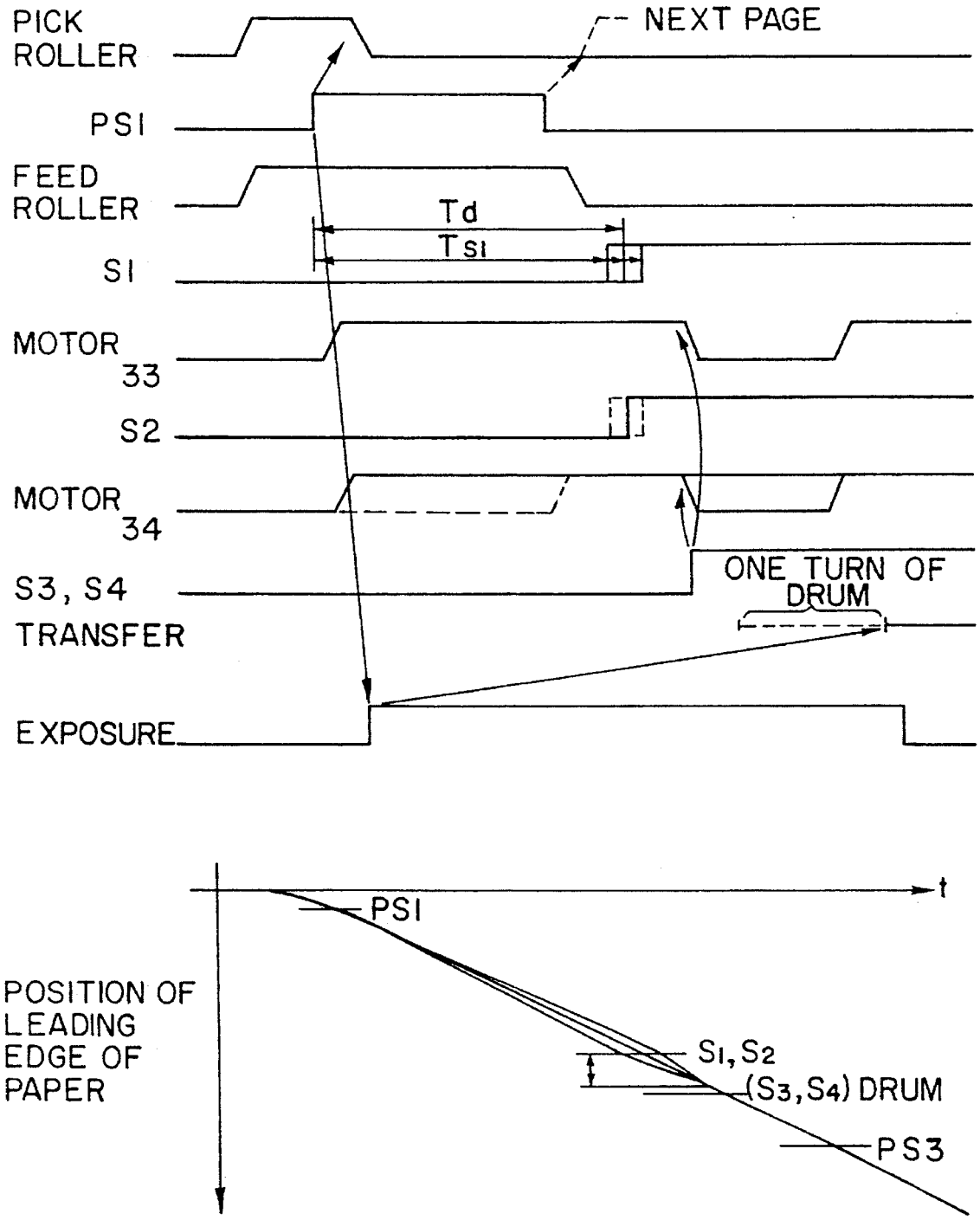
FIG. 17 is a time chart for the process illustrated in FIG. 16.
Figure 18A:
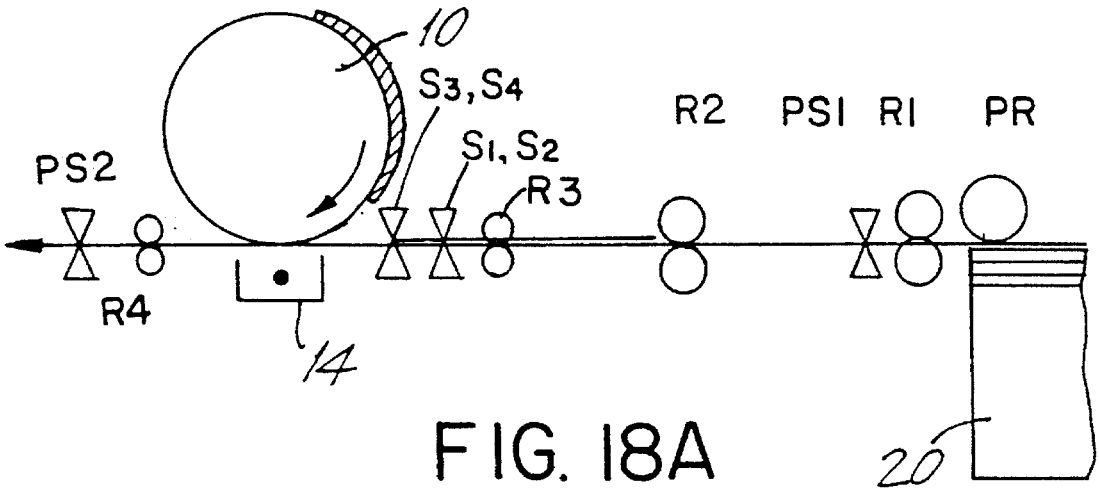
FIGS. 18A through 18C are explanatory diagrams for the process illustrated in FIG. 16.
Figure 18B:
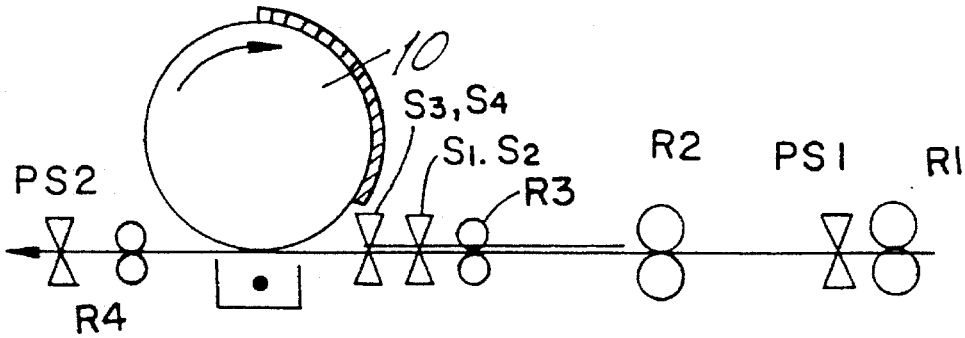

FIG. 15 is a structural diagram of an image forming apparatus according to a fifth modification of the present invention, FIG. 16 presents a flowchart of a positional-deviation compensating process according to the modification in FIG. 15, FIG. 17 is a time chart for the modification in FIG. 15 and FIGS. 18A and 18B are explanatory operational diagrams of the modification in FIG. 17.

FIG. 15 uses the same reference numerals as used in FIG. 5 to denote identical or corresponding components. Checking sensors S3 and S4 are provided closer to the transfer position side than the sheet sensors S1 and S2, and detect sheets.

This modification is the above-described first embodiment to which a process for the case where there occurs an uncompensatable positional deviation occurs is added. Instead of informing the upper-level apparatus of the occurrence of such an event as in the first modification, the processor 30 temporarily stops feeding the uncompensatable sheet and will then start feeding this sheet again. Printing will therefore be conducted after positional compensation.

As steps S1 to S5 and S7 in FIG. 15 are the same as those of the fourth embodiment, a description will be given of step S6 with reference to FIGS. 16, 17 and 18A–18C.

(S6) When the absolute values |ΔX1| and |ΔX2| of the positional deviations are larger than the maximum compensatable value |ΔXmax|, the processor 30 determines that compensation is not possible. The processor 30 then feeds the sheet without performing positional compensation. As shown in FIG. 18A, when the sheet passes the checking sensors S3 and S4, the processor 30 stops rotating the feed rollers R3 to establish the position of the sheet on the feeding path 19.

Figure 18C:
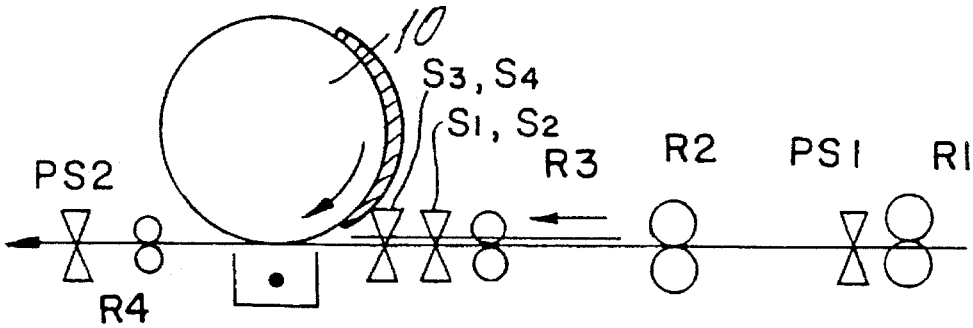

Then, the processor 30 waits for the photosensitive drum 10 to rotate until the leading position of the toner image on the photosensitive drum 10, as viewed from the transfer position, comes within the distance from the checking sensors S3 and S4 to the transfer position as shown in FIG. 18B. Then, the processor 30 rotates the feed rollers R3 to start feeding the sheet as shown in FIG. 18C.

When no positional compensation is possible, the sheet is temporarily stopped at a predetermined position as described above. As the sheet is fed again in synchronism with the movement of the toner image on the photosensitive drum 10, the positional deviation is compensated to allow for image transfer. This will prevent wasteful usages of toner images and sheets.

In other words, when no compensation is possible, the sheet is temporarily stopped and is then fed again in synchronism with the movement of the photosensitive drum 10, so that the uncompensatable sheet will be aligned with the toner image on the photosensitive drum 10.

Figure 19:
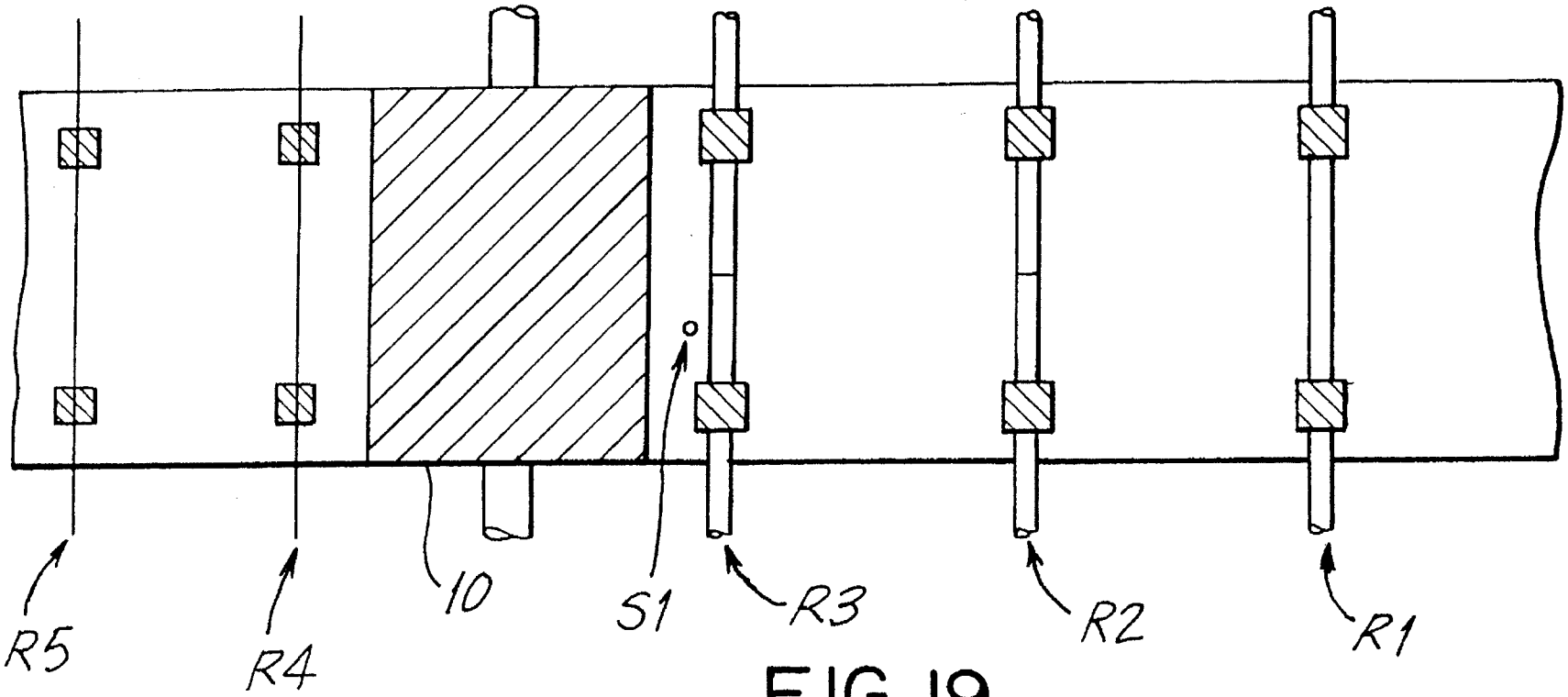
FIG. 19 is a top view of a feeding path according to a sixth modification of the present invention.
Figure 20:
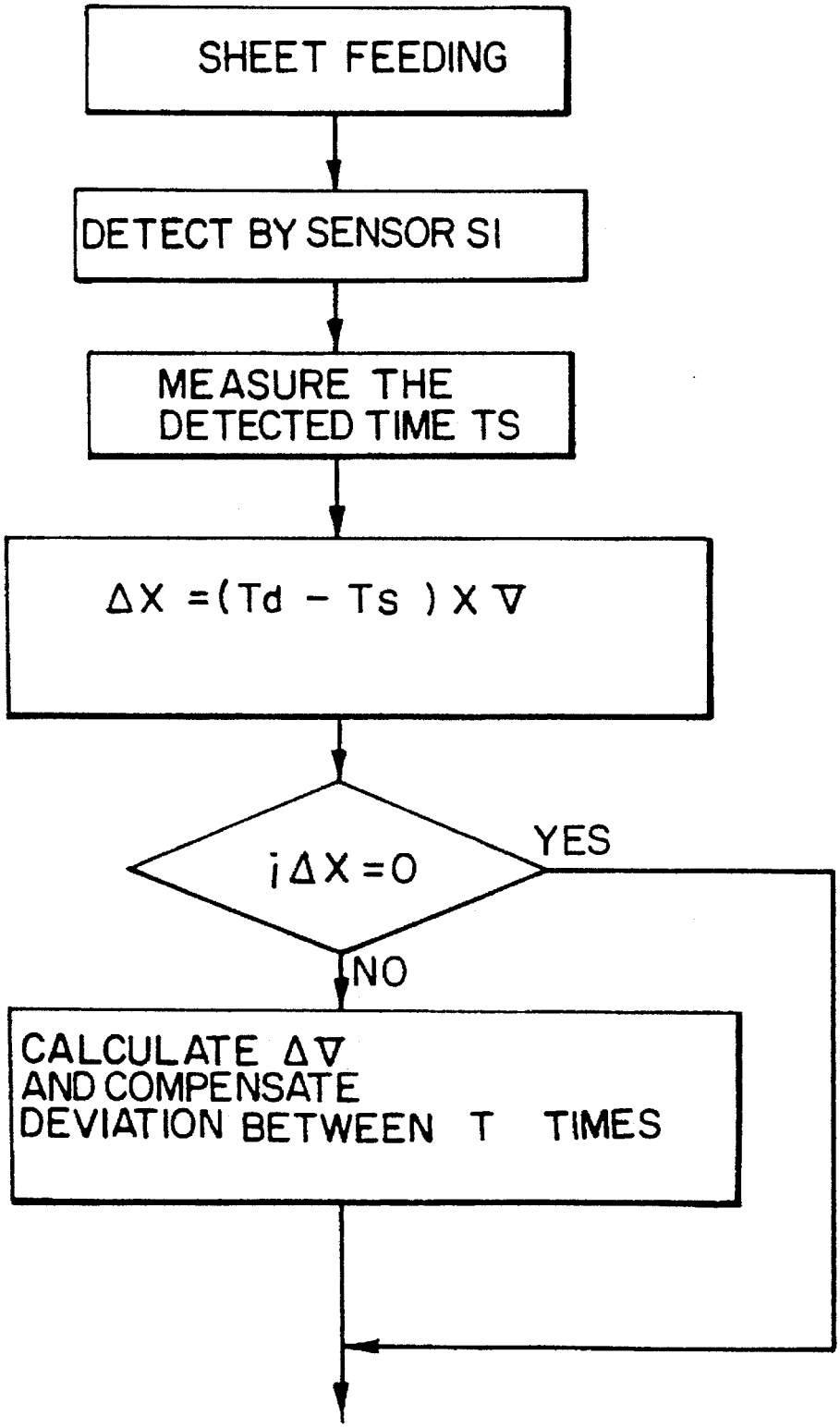
FIG. 20 is a flowchart of a positional-deviation compensating process of the modification shown in FIG. 19.

FIG. 19 is a top view of a feeding path according to a sixth modification of the present invention, and FIG. 20 is a flowchart of a positional-deviation compensating process of the modification shown in FIG. 19.

In FIG. 19, one sheet sensor S1 is provided on the transfer position side of the feed rollers R3. This example is a modification of the above-described first embodiment and is designed to execute only positional compensation with one sheet sensor without executing a skewing compensation.

As step S1 in this modification is the same as that of the first embodiment, the flow starting at step S2 will be discussed below.

(S2) When detecting the leading edge of the sheet being fed, the sheet sensor S1 produces a sheet detection output. Based on the detection output, the processor 30 stops the time measuring operation of the feed-time timer 35. Accordingly, the feeding time Ts of the sheet from the pickup sensor PS1 to the sheet sensor S1 will be measured.

(S3) Then, the processor 30 calculates the positional deviation ΔX of the sheet from the feeding time Ts. Given that a specified sheet-feeding time from the pickup sensor PS1 to the sheet sensor S1 is Td and the feeding speed is V, the positional deviation ΔX is given by the following equation:

$$\Delta X=(Td-Ts)\times V \tag{9}$$

(S4) The processor 30 then determines if the positional deviation ΔX is zero. If the positional deviation ΔX is zero, there is no positional deviation so that no positional compensation will be executed.

(S5) If the positional deviation ΔX is not zero, there is a positional deviation so that the processor 30 computes compensation speeds ΔV1 to compensate for the positional deviation of the sheet. Since the allowable moving distance L for the compensation is limited by the distance from the sheet sensor S1 to the transfer position, the compensation speed for compensating for any positional deviation will be calculated during the movement over the distance L. Given that the feeding speed is V, the positional compensation period is t and the speed in the deviation compensation period is v, the deviation compensation period t and the speed v in the deviation compensation period are expressed by the following equations:

$$v=L.V/(L+\Delta X) \tag{10}$$

$$t=L/v \tag{11}$$

Thus, the compensation speed ΔV and the deviation compensation period t are expressed by the following equations:

$$\Delta V=-\Delta X.V/(L+\Delta X) \tag{12}$$

$$\Delta t=(L+\Delta X)/V \tag{13}$$

The processor 30 adds the compensation speed ΔV to the feeding speed V and drives the feed motor 33 for the period t. When the sheet position deviates while the sheet moves from the pickup sensor PS1 to the sheet sensor S1, therefore, the sheet is conveyed at the positional-deviation compensation speed (V+ΔV) while the sheet moves from the position of the sheet sensor S1 to the transfer position at most. Therefore, the leading edge of the sheet will be aligned with the leading edge of the image forming position on the photosensitive drum 10 at the transfer position.

Since the sheet position is compensated during continuous sheet feeding, the distance d between sheets becomes smaller. This can reduce the unused area on the photosensitive drum 10, so that the photosensitive drum 10 will be used efficiently and the printing speed will be improved accordingly.

The present invention may be modified in the following forms besides the above-described embodiment and modifications.

First, to check the result of the positional compensation, the trailing edge of a sheet is detected by the sheet sensors S1 and S2 after positional compensation. Then, the positional deviation may be computed in the above-described manner to check the result of the positional compensation. More specifically, the controller 30 measures the time at which the trailing edge of the sheet is detected in accordance with the trailing-edge detection output of the detecting means S1. The need for a compensation operation is checked by comparing the trailing-edge detecting time with a specified time. Accordingly, the need for a compensation operation can be checked using the detecting means S1.

Likewise, the need for the positional compensation may be checked by using the checking sensors S3 and S4 as in the fifth modification. More specifically, the checking detection means S3 and S4 are provided on the transfer position side of the feeding path. The controller 30 measures the detecting time in accordance with the detection outputs of the checking detection means S3 and S4. Further, the need for a compensation operation may be checked by comparing the detected times with the specified time.

To allow for sheet recovery after the checking, it is determined whether positional compensation is possible under the compensation control by comparing the difference between the detected times, which is the control amount, with the specified time difference. When the detected time difference is larger than the specified time difference, no positional compensation is possible and the attempt to compensate for the positional deviation is wasteful so that no positional compensation will be performed. Instead, this situation may be reported to the upper-level apparatus to suggest a recovery process.

Instead of informing the upper-level apparatus of the occurrence of such a case, this occurrence of the event may be displayed on a display unit of the apparatus to inform the operator of the current situation.

Although the foregoing description has been given with reference to an electrophotographing mechanism as the image forming apparatus, the present invention may be applied to a printing mechanism for transferring a toner image (e.g., electrostatic recording mechanism). The type of sheets is not limited to paper but other media may be used as well. While the foregoing description has been given with reference to the image forming apparatus being a printer, the present invention may also be adapted for other image forming apparatuses, such as a copying machine and facsimile. Further, the transfer means, which has been described as a transfer charger, may be transfer rollers.

Although only one embodiment of the present invention and several modifications have been described herein, it should be apparent to those skilled in the art that the present invention may be embodied in many other specific forms without departing from the spirit or scope of the invention.

In short, according to the present invention, the time for sheet feeding from a predetermined position of the sheet to the detection position is measured based on the output of the detecting means S1 to detect the amount of a positional deviation. As the feeding speed of the feeding means is controlled in accordance with the amount of the positional deviation, the positional compensation can be executed without stopping sheets. Accordingly, the distance between sheets can be shorted and the distance to the next image forming position on the photosensitive drum can be shorted, thus improving the printing performance. Further, an image will be formed faster with the shortened distance.

Since a variation in speed at the time of continuously feeding sheets becomes very small as compared with that in the prior art, the feeding distance required for the sheet to reach the rotational speed of the image forming body 10 can be suppressed. As a result, the precision of aligning the sheet with the toner image will be further improved.

What is claimed is:

1. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed; and control means for controlling a feeding speed of said feeding means to compensate for a transfer position of said sheet, in accordance with a measured feeding time from said first predetermined position to said second predetermined position based on outputs of said first and second detecting means, wherein:

said control means computes an amount of a positional deviation from a time difference between said feeding time and an expected time, computes a compensation speed and a compensation period from a computed positional deviation amount, and controls said feeding means to said compensation speed only for said compensation period, and said control means computes a compensation speed and a compensation period from a distance from said second predetermined position to said transfer position and said computed positional deviation amount, and controls said feeding means to said compensation speed only for said compensation period.

2. The image forming apparatus according to claim 1, wherein said feeding means is constituted of a plurality of feed rollers; and said control means controls a feeding speed of a pair of feed rollers closest to said transfer position among said plurality of feed rollers.

3. The image forming apparatus according to claim 2, wherein said second detecting means is provided between said feed rollers closest to said transfer position and said transfer position.

4. The image forming apparatus according to claim 1, further comprising:

a hopper for retaining said sheet; and a pickup mechanism for picking up said sheet from said hopper; and wherein said first detecting means is a pickup sensor for detecting a pickup of said sheet by said pickup mechanism.

5. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means;

a hopper for retaining said sheet; and a pickup mechanism for picking up said sheet from said hopper;

wherein said first detecting means is a pickup sensor for detecting a pickup of said sheet by said pickup mechanism.

6. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein said control means computes an amount of a positional deviation from a time difference between said feeding time and an expected time, computes a compensation speed and a compensation period from a computed positional deviation amount, and controls said feeding means to said compensation speed only for said compensation period;

a hopper for retaining said sheet; and a pickup mechanism for picking up said sheet from said hopper;

wherein said first detecting means is a pickup sensor for detecting a pickup of said sheet by said pickup mechanism.

7. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means;

wherein said feeding means is constituted of a plurality of feed rollers, and said control means controls a feeding speed of a pair of feed rollers closest to said transfer position among said plurality of feed rollers;

a hopper for retaining said sheet; and a pickup mechanism for picking up said sheet from said hopper; and wherein said first detecting means is a pickup sensor for detecting a pickup of said sheet by said pickup mechanism.

8. An image forming apparatus comprising:

an endless type rotatable image forming body;

image forming means for forming an image on said image forming body;

transfer means for transferring said image on said image foxing body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means;

a hopper for retaining said sheet; and a pickup mechanism for picking up said sheet from said hopper;

wherein said first detecting means is a pickup sensor for detecting a pickup of said sheet by said pickup mechanism, and wherein:

said feeding means is constituted of a plurality of feed rollers;

said control means controls a feeding speed of a pair of feed rollers closest to said transfer position among said plurality of feed rollers; and said second detecting is provided between said feed rollers closest to said transfer position and said transfer position.

9. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein:

said feeding means is constituted of a plurality of feed rollers;

said control means controls a feeding speed of a pair of feed rollers closest to said transfer position among said plurality of feed rollers;

said second detecting means comprises a pair of sensors arranged perpendicular to a feeding direction of said sheet;

each of said pair of feed rollers is constituted of a pair of independently drivable feed rollers, and said control means measures left and right feeding times of said sheet from an output of said first detecting means and outputs of said pair of sensors of said second detecting means, and controls said feeding speed of said pair of independently drivable feed rollers in accordance with said measured feeding times; and further comprising:

a hopper for retaining said sheet; and a pickup mechanism for picking up said sheet from said hopper; and wherein said first detecting means is a pickup sensor for detecting a pickup of said sheet by said pickup mechanism.

10. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein:

said control means computes an amount of a positional deviation from a time difference between said feeding time and an expected time, computes a compensation speed and a compensation period from a computed positional deviation amount, and controls said feeding means to said compensation speed only for said compensation period, and said control means compares said time difference with a specified time difference and informs an upper-level apparatus of an uncompensatable situation when said time difference is greater than said specified time difference.

11. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein:

said control means computes an amount of a positional deviation from a time difference between said feeding time and an expected time, computes a compensation speed and a compensation period from a computed positional deviation amount and controls said feeding means to said compensation speed only for said compensation period, and said control means compares said time difference with a specified time difference and indicates an uncompensatable situation on display means of said image forming apparatus when said time difference is greater than said specified time difference.

12. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein said control means computes an amount of a positional deviation from a time difference between said feeding time and an expected time, computes a compensation speed and a compensation period from a computed positional deviation amount, and controls said feeding means to said compensation speed only for said compensation period; and a distributing mechanism, provided in front of said transfer position in a feeding direction of said sheet, for distributing said sheet from said feeding path; and wherein said control means causes said distributing mechanism to distribute said sheet from said feeding path when said time difference is larger than a specified time difference.

13. The image forming apparatus according to claim 12, wherein said control means performs control in such a way that said distributing mechanism distributes all sheets on said feeding path from said feeding path.

14. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein:

said control means computes an amount of a positional deviation from a time difference between said feeding time and an expected time, computes a compensation speed and a compensation period from a computed positional deviation amount, and controls said feeding means to said compensation speed only for said compensation period, and said control means controls said feeding means in such a way that when said time difference is greater than a specified time difference, feeding of said sheet is stopped temporarily and is started again in synchronism with rotation of said image forming body.

15. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein:

said control means computes an amount of a positional deviation from a time difference between said feeding time and an expected time, computes a compensation speed and a compensation period from a computed positional deviation amount, and controls said feeding means to said compensation speed only for said compensation period, and said control means checks an amount of a positional deviation of said sheet after compensation in accordance with a detection output of said second detecting means representing detection of a trailing edge of said sheet.

16. The image forming apparatus according to claim 15, wherein said control means informs an upper-level apparatus of an uncompensatable situation when said positional deviation amount is greater than a specified amount.

17. The image forming apparatus according to claim 15, wherein said control means indicates an uncompensatable situation on a display unit of said image forming apparatus when said positional deviation amount is greater than a specified amount.

18. An image forming apparatus comprising:

an endless type rotatable image forming body;

image forming means for forming an image on said image forming body;

transfer means for transferring said image on said image forming body onto a sheet being fed;

feeding means for feeding said sheet;

first detecting means for detecting said sheet being fed at a first predetermined position in a feeding path of said sheet;

second detecting means, located on a side of said transfer means at a second predetermined position, for detecting said sheet being fed;

control means for controlling a feeding speed of said feeding means to compensate for a transfer position of said sheet, in accordance with a measured feeding time from said first predetermined position to said second predetermined position based on outputs of said first and second detecting means, wherein said control means computes an amount of a positional deviation from a time difference between said feeding time and an expected time, computes a compensation speed and a compensation period from said computed positional deviation amount, and controls said feeding means to said compensation speed only for said compensation period; and third detecting means, provided closer to said transfer position than said second detecting means, for detecting said sheet; and wherein said control means checks an amount of a positional deviation of said sheet after compensation in accordance with a sheet detection output of said third detecting means.

19. The image forming apparatus according to claim 18, wherein said control means informs an upper-level apparatus of an uncompensatable situation when said positional deviation amount is greater than a specified amount.

20. The image forming apparatus according to claim 18, wherein said control means indicates an uncompensatable situation on a display unit of said image forming apparatus when said positional deviation amount is greater than a specified amount.

* * * * *